US006913351B2

(12) United States Patent
Yamaguchi et al.

(10) Patent No.: US 6,913,351 B2
(45) Date of Patent: Jul. 5, 2005

(54) LIQUID JET RECORDING HEAD AND RECORDING APPARATUS

(75) Inventors: Yukuo Yamaguchi, Tokyo (JP); Yutaka Koizumi, Kanagawa (JP); Mikiya Umeyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/359,055

(22) Filed: Feb. 6, 2003

(65) Prior Publication Data

US 2003/0156154 A1 Aug. 21, 2003

(30) Foreign Application Priority Data

Feb. 15, 2002 (JP) ..... 2002-039243

(51) Int. Cl.[7] ..... B41J 2/175
(52) U.S. Cl. ..... 347/87
(58) Field of Search ..... 347/49, 50, 58, 347/87, 85, 33

(56) References Cited

U.S. PATENT DOCUMENTS 5,555,461 A * 9/1996 Ackerman ..... 347/33
5,583,549 A * 12/1996 Ujita et al. ..... 347/86
5,805,187 A * 9/1998 Sasaki ..... 347/86
5,940,957 A 8/1999 Goto et al.
6,406,137 B1 6/2002 Okazaki et al.
2002/0012021 A1 1/2002 Umeyama et al.
2003/0016278 A1 1/2003 Yamaguchi et al.

FOREIGN PATENT DOCUMENTS

EP 0822084 A3 * 12/1998 ..... B41J/2/14
JP 2001-277521 10/2001

OTHER PUBLICATIONS

U.S. Appl. No. 09/655,372, filed Sep. 2000, Umeyama et al.
U.S. Appl. No. 10/356,509, filed Feb. 2003, Yamaguchi et al.

* cited by examiner

*Primary Examiner*—Anh T.N. Vo
(74) *Attorney, Agent, or Firm*—Fitzpatrick, Cella, Harper & Scinto

(57) ABSTRACT

A liquid jet recording head includes a recording portion having a recording element substrate provided with a recording element for discharging liquid and a face surface provided with a discharge port for discharging liquid, a recording liquid storing portion for storing the recording liquid supplied to the recording portion, and a coupling member for coupling the recording portion and the recording liquid storing portion. A projecting member is provided on the recording liquid storing portion. The coupling member couples the recording portion and the recording liquid storing portion so that a leading end of the projecting member projects toward an end of the face surface from a side of the recording portion when the recording portion is coupled with the recording liquid storing portion.

12 Claims, 16 Drawing Sheets

53

LIQUID JET RECORDING HEAD AND RECORDING APPARATUS

BACKGROUND OF THE INVENTION

1. Field of the Invention

The present invention relates to a liquid jet recording head for discharging a liquid such as a recording liquid and the like from discharge ports and forming liquid droplets and to a recording apparatus including the liquid jet recording head.

2. Related Background Art

A recording apparatus having a function as a printer, copy machine, facsimile and the like, or a recording apparatus used as an output device of composite type electronic equipment including a computer, word processor, and the like and used as an output device of a workstation is arranged to record information such as an image and the like on a recording medium such as a recording sheet, plastic thin sheet and the like based on recording information. This type of the recording apparatus can be classified into an ink jet system, wire dot system, thermal system, laser beam system and the like.

FIG. 16 shows a perspective view of an outside appearance of a conventional liquid jet recording head, and FIG. 17 shows an exploded perspective view of a conventional liquid jet recording head.

As shown in FIGS. 16 and 17, the conventional liquid jet recording head includes recording element substrates 201 for discharging liquid droplets, a support substrate 202 for supporting the recording element substrate 201, wiring sheets 203 and a terminal wiring substrate 205 for supplying a recording signal to the recording element substrates 201, and a flow path-forming member 206 having a flow path for supplying a recording liquid to the recording element substrates 201.

In the recording apparatus described above, the recording liquid may be attached in a wet state to a recording liquid discharge surface, on which discharge ports are disposed, due to mists, satellites (a part of liquid droplets separated from discharged liquid droplets), and the like generated when the recording liquid is discharged from the liquid jet recording head. Further, in a recover process for sucking the recording liquid remaining in the discharge ports therefrom, and the like, the recording liquid which is not sucked and remains may be attached on the recording liquid discharge surface.

To cope with the above problem, the conventional recording apparatus includes a recovery unit for removing the recording liquid adhered to and remaining on the recording liquid discharge surface. The recovery unit is mainly composed of a suction mechanism for forcibly discharging the recording liquid by sucking it from the discharge ports of the recording liquid discharge surface and a wiping mechanism for cleaning the recording liquid discharge surface by wiping the recording liquid therefrom.

The wiping mechanism has a blade composed of, for example, an elastic member and the like and cleans a plurality of the discharge ports and the periphery thereof in such a manner that the distal end of the blade is directly abutted against the recording liquid discharge surface of the liquid jet recording head and is caused to be in sliding contact with the discharge surface while it is moved relatively with respect to the discharge surface, thereby the stability of a discharging operation can be secured.

An example of the recovery unit will be described below with reference to the drawings. FIG. 18 shows a perspective view of a recording apparatus having the recovery unit, and FIG. 19 shows a schematic side elevational view of a wiping operation executed by the recovery unit. As shown in FIG. 18, a liquid jet recording head 301 is mounted on a carriage 302, discharges the recording liquid from the discharge ports of a recording liquid discharge surface 301*a*, and records information such as an image and the like on a recording medium 305. The carriage 302 is supported by a guide shaft 303 for guiding a moving direction thereof and moves reciprocally in confrontation with the recording medium 305. The recording medium 305 is caused to come into pressure contact with a feed roller (not shown) by a pinch roller (not shown) and is transported by the feed roller being rotated.

Further, the recording medium 305 on which desired information has been recorded is discharged to the outside of the recording apparatus by a discharge roller (not shown). Then, dust such as paper powder and the like adhered to the recording liquid discharge surface 301*a* and the recording liquid remaining thereon are scraped by a blade 304 disposed to the outside of a recording region (wiping mechanism). In addition, a cap 306 is provided to prevent the clogging of the discharge ports, which is caused when the recording liquid adhered thereto is dried, by covering the recording liquid discharge surface 301*a* and to suck the recording liquid from the outside of the liquid jet recording head (suction mechanism). Here, a conventional method of an operation (wiping operation) for cleaning the recording liquid discharge surface 301*a* by scraping the dust and the recording liquid thereon by the blade 304 will be described.

In FIG. 19, reference numerals $P_1$, $P_2$, and $P_3$ show respective states of of the blade 304, that is, commencement of the wiping operation, during the wiping operation, and after termination of the wiping operation.

When the blade 304 is moved by the wiping mechanism in the direction of an arrow V in FIG. 19, it comes into sliding contact with and moves on the recording liquid discharge surface of the liquid jet recording head 301. That is, when the wiping operation starts, the distal end of the blade 304 is subjected to the sliding resistance of a side surface of the liquid jet recording head 301, is elastically deformed in a curved state, and comes into press-contact with the recording liquid discharge surface 301*a*. Since the liquid jet recording head 301 is further moved in the press-contact state, the dust and the recording liquid adhered onto the surface of the recording liquid discharge surface 301*a* is scraped with the distal end of the blade 304. Thus, when the liquid jet recording head 301 has entirely passed through the blade 304, the original upright state of the blade 304 is elastically restored.

As described above, the wiping mechanism cleans the recording liquid discharge surface 301*a* through a series of the wiping operation executed by the blade 304, thereby the discharging operation of the recording liquid can be stabilized, and an excellent recorded image and the like can be obtained.

When the wiping operation is carried out, the periphery of the discharge ports is sufficiently cleaned. However, a problem is arisen in that the recording liquid deposits on the side from which the blade 304 comes onto the recording liquid discharge surface 301*a*.

In other words, repetition of the wiping operation causes the wiped recording liquid to deposit on the distal end of the blade 304. Accordingly, when the blade 304 comes onto the recording liquid discharge surface 301*a* next, the recording liquid deposited on the distal end of the blade 304 is transferred to and deposited on the side surface of the recording liquid discharge surface 301*a* from which the blade 304 comes onto the recording liquid discharge surface 301*a*. Moreover, the deposited recording liquid is dragged by the blade 304 and rubbed onto the recording liquid discharge surface 301*a*.

Further, there is a possibility that the recording liquid deposited on the side surface and the like of the recording liquid discharge surface 301*a* rises from the wiring sheet 203 side to a connection terminal 204 by a capillary action. To prevent the arrival of the remaining recording liquid at the connection terminal 204, the conventional liquid jet recording head employs a countermeasure for preventing the rising of the recording liquid by forming a barrier wall composed of a seal agent, adhesive or the like between the connection terminal 204 and a bent portions 203*a* of the wiring sheets 203.

In contrast, on a leaving side of the recording liquid discharge surface 301*a* from which the blade 304 leaves, the blade 304 attempts to return to an upright state by the elastic recovering action thereof after it cleans the recording liquid discharge surface 301*a*. The blade 304 is excessively oscillated by the recovering action and scatters the collected recording liquid in a mist state in the leaving direction of the blade 304 due to the oscillation.

In general, the wiping mechanism sets a direction in which the wiping operation is carried out to any one of four directions, that is, directions in which the discharge ports as described above are disposed and directions orthogonal to the disposing directions of the discharge ports. However, when the wiping operation is carried out in the directions orthogonal to the disposing directions of the discharge ports, there is a possibility that recording quality is deteriorated because many kinds of recording liquids are mixed with each other by the mists and the like scattered in the wiping operation.

Further, when the blade 304 comes onto the recording liquid discharge surface 301*a*, the distal end of the blade 304 is caught by side ends 203*c* of the wiring sheets 203 positioned at the outer periphery of the recording liquid discharge surface 301*a*. Thus, the blade 304 and the wiring sheets 203 are greatly damaged by the repetition of the wiping operation.

As a countermeasure for solving the above problem, when the blade 304 comes on to the recording liquid discharge surface 301*a* from the bent portions 203*a* of the wiring sheets 203 and the wiping operation is carried out in the disposing direction of the discharge ports, the damage of the blade 304 and the wiring sheets 203 as described above can be avoided.

Accordingly, as shown by the direction of the arrow V, a serial type recording apparatus generally employs the wiping operation of the blade 304 in which the blade 304 comes onto the recording liquid discharge surface 301*a* from the side of the bent portions 203*a* of the wiring sheets 203, which is an electrically connecting side (from the side of a back surface of the liquid jet recording head), and leaves to the front surface side of the liquid jet recording head (for example, the direction of an arrow S in FIG. 12).

In contrast, particularly in a mailing machine and the like of a line type recording apparatus, since a recording region of a recording medium is disposed forward of a front surface of the liquid jet recording head, mists of the recording liquid and the like produced by the wiping operation must be prevented from scattering to the recording region of the recording medium. Thus, the blade 304 comes onto the recording liquid discharge surface 301*a* from the front surface of the liquid jet recording head and leaves to an electrically connecting portion of the liquid jet recording head (the back surface of the liquid jet recording head).

However, as shown in FIGS. 16 to 19, when the blade 304 comes onto the recording liquid discharge surface 301*a* from the front surface of the liquid jet recording head in the conventional recording apparatus, the distal end of the blade 304 is caught by end portions 203*b* of the wiring sheets 203. Thus, a problem is arisen in that the recording liquid is liable to deposit on stepped portions formed by the end portions 203*b* of the wiring sheets 203.

Further, in the conventional recording apparatus, there is a possibility that the end portions 203*b* of the wiring sheets 203 are exfoliated from the support substrate 202 by the repetition of the wiping operation. When the end portions 203*b* of the wiring sheet 203 are exfoliated even in a slight amount, the wiring sheets 203 are furthermore exfoliated by the wiping operation carried out repeatedly thereafter. Thus, in the conventional recording apparatus, a disadvantage is arisen in that the liquid jet recording head is damaged or cannot be sufficiently cleaned.

To prevent the blade 304 from being caught by the end portions 203*b* of the wiring sheets 203 by avoiding the above problem, there is contemplated a countermeasure for regulating a region in which the blade 304 comes into sliding contact with the recording liquid discharge surface 301*a* by reducing the movable range of the blade 304.

However, in the above countermeasure, first, the blade 304 must be advanced to and retracted from the recording liquid discharge surface 301*a*, which is disadvantageous in that a manufacturing cost of the wiping mechanism is increased. Second, a disadvantage is also arisen in that there is a possibility that dust and dirt (dust, paper powder, paper fluff and the like) and viscosity-increased ink (ink having whose viscosity is increased by the evaporation of a volatile component) which were collected by the blade 304 in the wiping operation are adhered again. That is, since the dust and the viscosity-increased ink collected by the distal end of the blade 304 and adhered thereto in the wiping operation are pressed against and transferred onto the recording liquid discharge surface 301*a* when the blade 304 advances and retracts, there is a possibility that the viscosity-increased ink is strongly and firmly adhered.

As described above, the countermeasure for regulating the sliding-contact region between the blade 304 and the recording liquid discharge surface 301*a* is not advantageous.

Further, when liquid jet recording heads having the same specification are mounted on a serial type recording apparatus on one hand and mounted on a line type recording apparatus on the other hand, two types of liquid jet recording heads must be manufactured to cope with wiping directions different from each other. This increases a manufacturing cost of the liquid jet recording heads and deteriorates productivity.

SUMMARY OF THE INVENTION

An object of the present invention is to provide a liquid jet recording head capable of reliably preventing exfoliation of a wiring sheet from a side end thereof when a surface of the recording head from which a liquid is discharged is cleaned and capable of securing excellent recording liquid discharge characteristics and to provide a recording apparatus including the liquid jet recording head.

To achieve the above object, a liquid jet recording head according to the present invention includes a holder member for detachably holding a recording liquid storage unit storing a recording liquid therein or a recording liquid storage tank storing the recording liquid therein; and a recording unit coupled with the holder member and comprising a recording element substrate on which a plurality of recording elements are disposed to discharge the recording liquid, a flexible wiring sheet disposed so as to cover the periphery of the recording element substrate for transmitting a recording signal to the recording element substrate, a flow path-forming member on which a recording liquid supply path is disposed to supply the recording liquid to the recording element substrate, and a porous member for filtering the recording liquid to thereby record information on a recording medium, wherein an end portion of the wiring sheet is fixed on the surface of the recording unit on the recording liquid discharge side thereof, and a projecting section is disposed to the recording liquid storage unit or to the holder member, the projecting section extending toward the outer periphery of the surface of the recording unit on the recording liquid discharge side thereof such that the distal end of the projecting section projects beyond the surface on the recording liquid discharge side.

According to the liquid jet recording head of the present invention arranged as described above, when a recovery unit which a recording apparatus includes executes a cleaning operation with a sliding contact member thereof in sliding contact with the surface on the liquid discharge side, the sliding contact member reaches the surface on the liquid discharge side without being caught by a ridge line of a side end of the wiring sheet. Thus, according to the liquid jet recording head, the wiring sheet can be prevented from being exfoliated from a side end of one end portion of the wiring sheet. Further, the projecting section can be easily manufactured at a low cost because it has a very simple structure such that it is extended from the recording liquid storage unit or from the holder member toward the outer peripheral edge of the surface of the recording unit on the liquid discharge side thereof.

According to a liquid jet recording head of the present invention, the recording unit may be coupled with the recording liquid storage unit or with the holder member through elastic coupling means. With this arrangement, the recording unit can be easily disassembled from the recording liquid storage unit or from the holder member as compared with an arrangement in which the recording unit is coupled with the recording liquid storage unit or with the holder member through screws, an adhesive or the like, and thus they can be easily recycled. Further, the liquid jet recording head can be manufactured at a low cost because productivity is enhanced.

In a liquid jet recording head according to the present invention, the projecting section may include engagement means for engaging the recording unit with the recording liquid storage unit or with the holder member. With this engagement means, the distal end of the projecting section can be prevented from being separated from the wiring sheet even if an external load is applied to the projecting section.

In a liquid jet recording head according to the present invention, it is preferable that the projecting section be disposed in the vicinity of the coupling means. With this arrangement, a weak point of a coupled state achieved by the coupling means can be covered. As a result, since sufficient coupling strength can be secured even if the coupling means has a small size, it is possible to reduce the size thereof, thereby the liquid jet recording head can be reduced in size in its entirety.

Further, a recording apparatus according to the present invention includes a liquid jet recording head of the present invention described above and a recovery unit having a sliding contact member for wiping a recording liquid in sliding contact with the surface of the liquid jet recording head on the liquid discharge side thereof.

In the recording apparatus arranged as described above, since the sliding contact member reaches the surface on the recording liquid discharge side, it is possible to securely execute a cleaning operation of the surface on the liquid discharge side, thereby the durability of the sliding contact member can be improved.

DESCRIPTION OF THE PREFERRED EMBODIMENTS

Specific embodiments according to the present invention will be described below with reference to the drawings.

First, liquid jet recording heads of the embodiments are recording heads employing an ink jet recording system. Among them, the liquid jet recording heads of the embodiments are particularly recording heads employing a system having means for generating thermal energy used as energy for discharging liquid ink and changing a state of the liquid ink by the thermal energy. Employment of this system achieves recording of very fine and dense characters, images, and the like. In particular, these embodiments use a heat generating resistor as the means for generating the thermal energy and discharge the ink making use of a pressure generated by bubbles which are produced when the ink is heated by the heat generating resistor and film-boiled. However, the system for discharging the ink is by no means limited to the system using the heat generating resistor, and a system for applying mechanical oscillation to the ink using an electromechanical converter such as a piezoelectric element and the like and for discharging the ink making use of a pressure generated by the oscillation.

Figure 1:
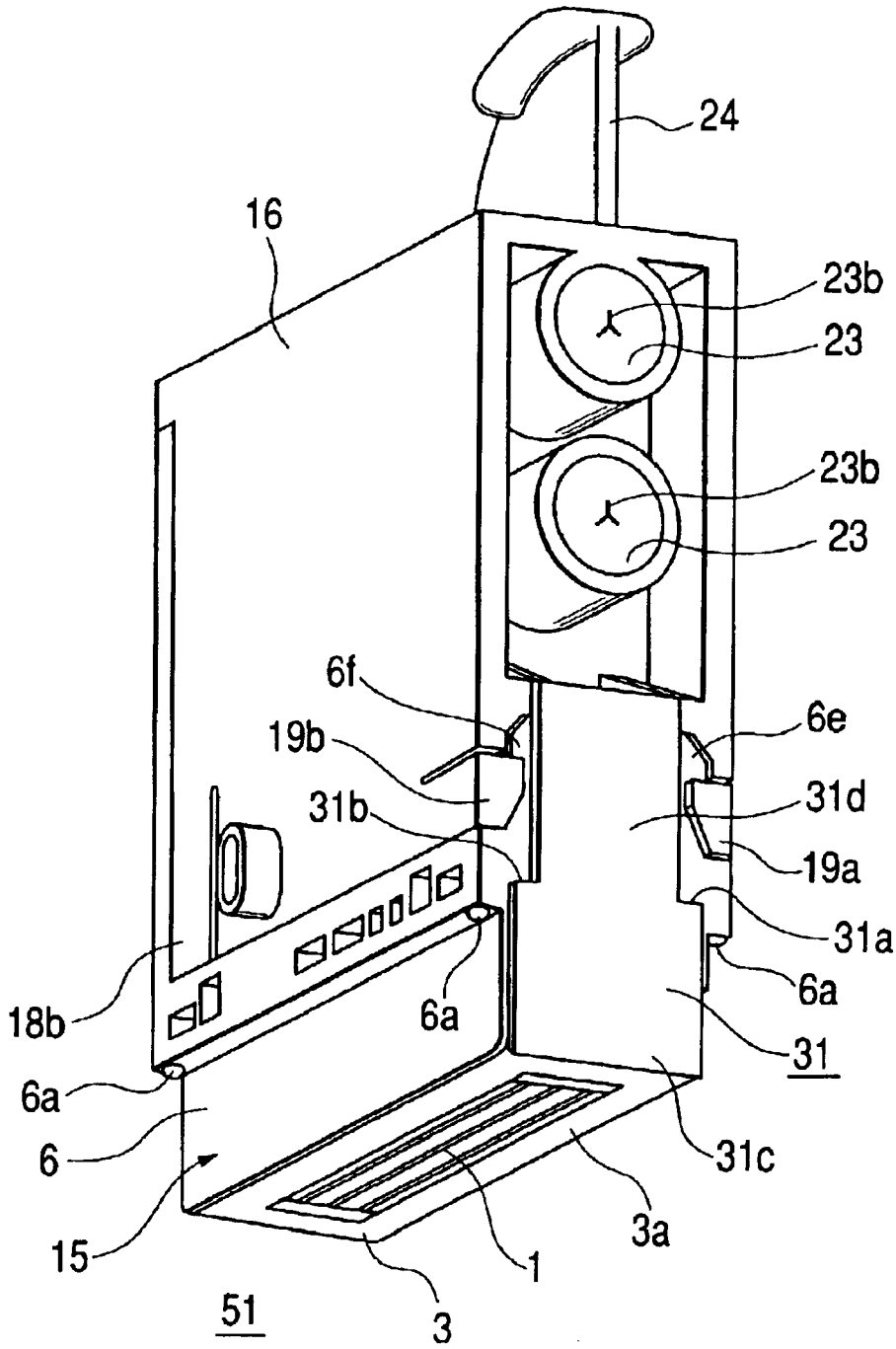
FIG. 1 is a perspective view showing an outside appearance of a liquid jet recording head according to a first embodiment according to the present invention.
Figure 2:
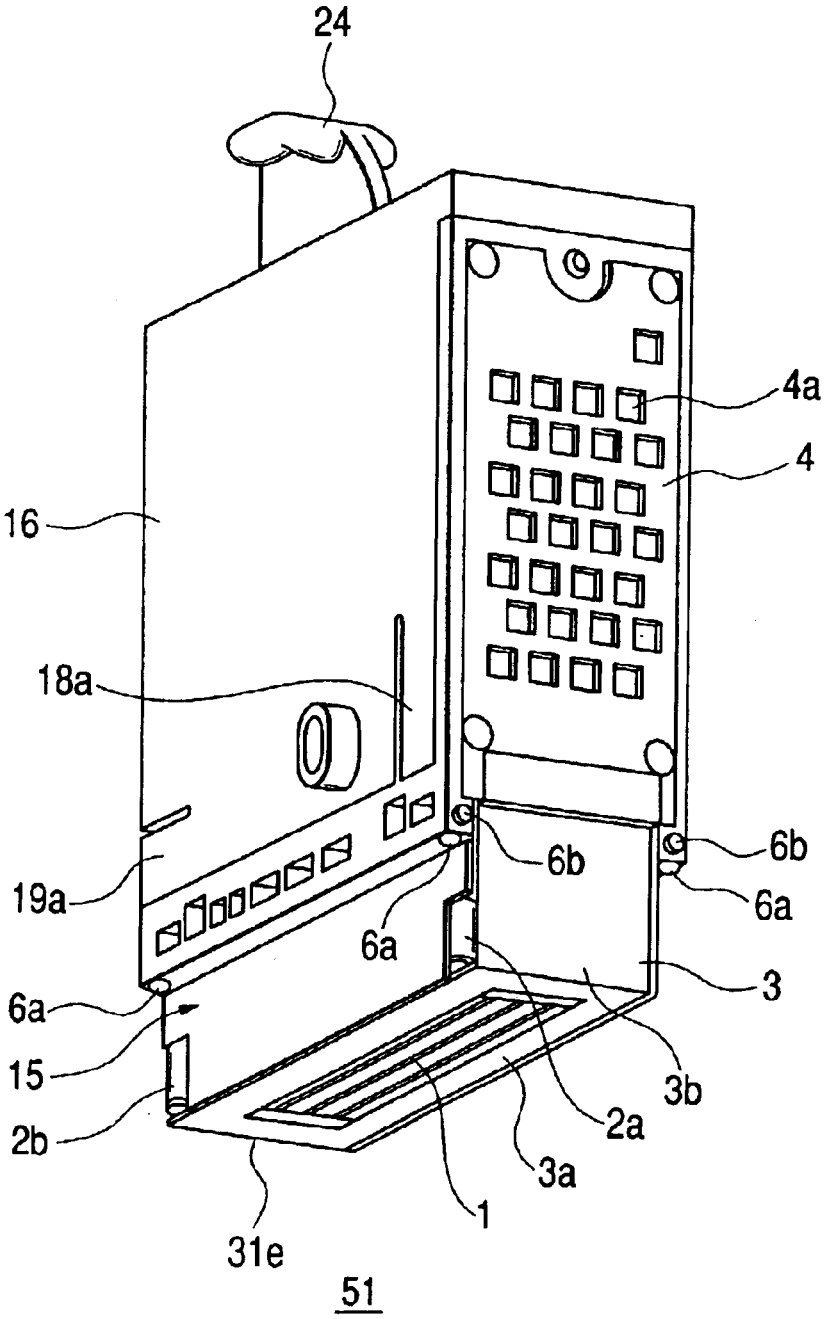
FIG. 2 is a perspective view showing an outside appearance of the liquid jet recording head from a terminal wiring substrate side.
Figure 3:
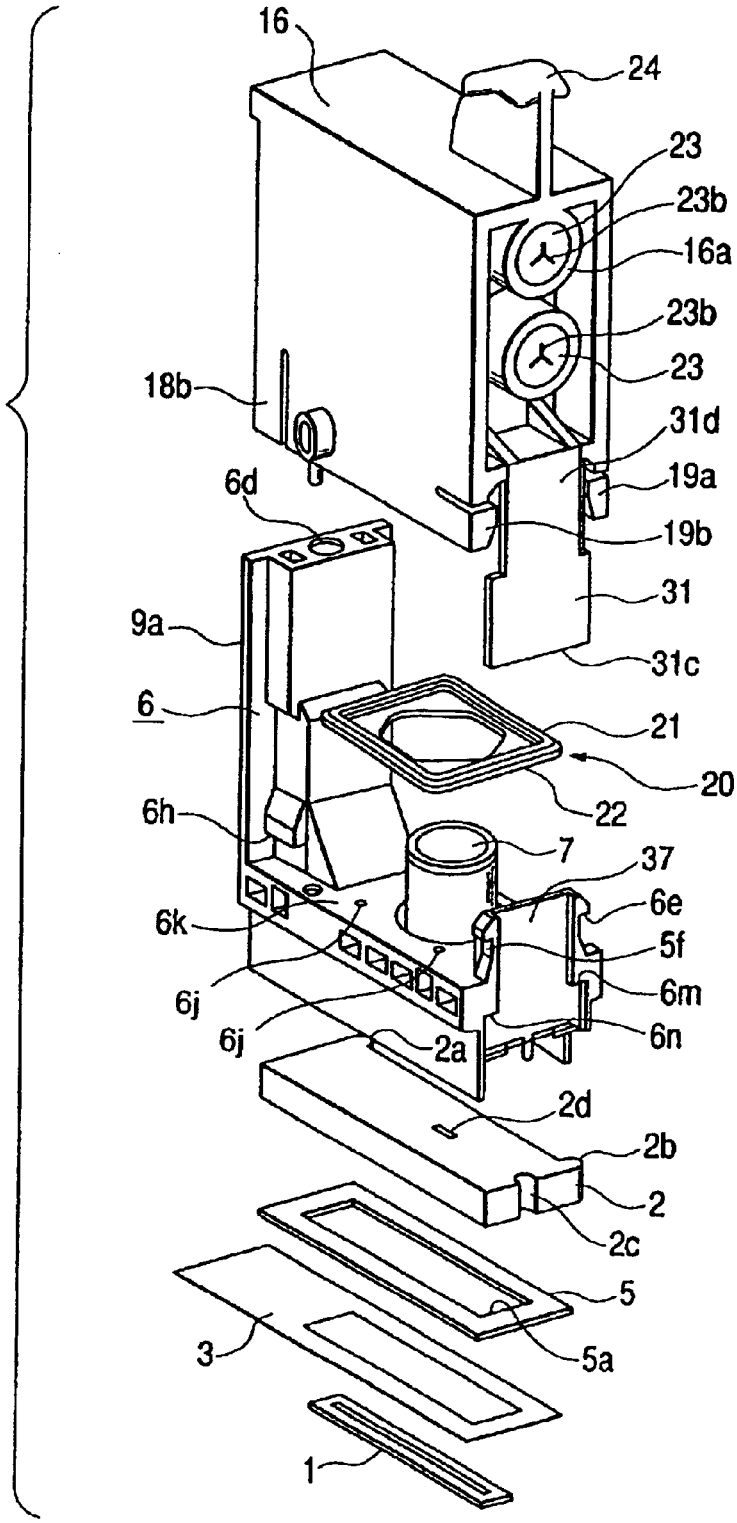
FIG. 3 is an exploded perspective view showing the liquid jet recording head.
Figure 4:
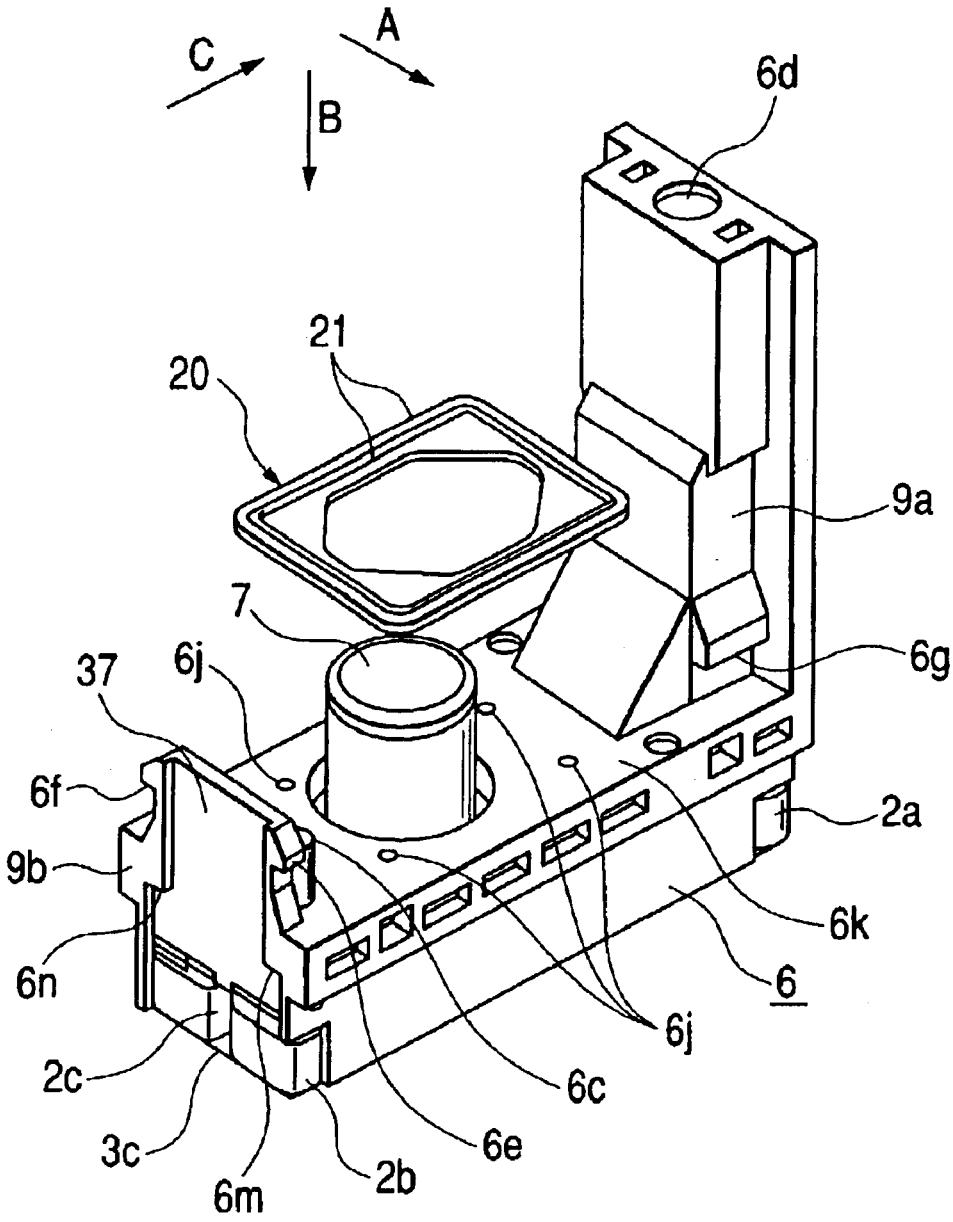
FIG. 4 is a perspective view showing a recording unit when it is viewed from above a flow path-forming member.
Figure 5:
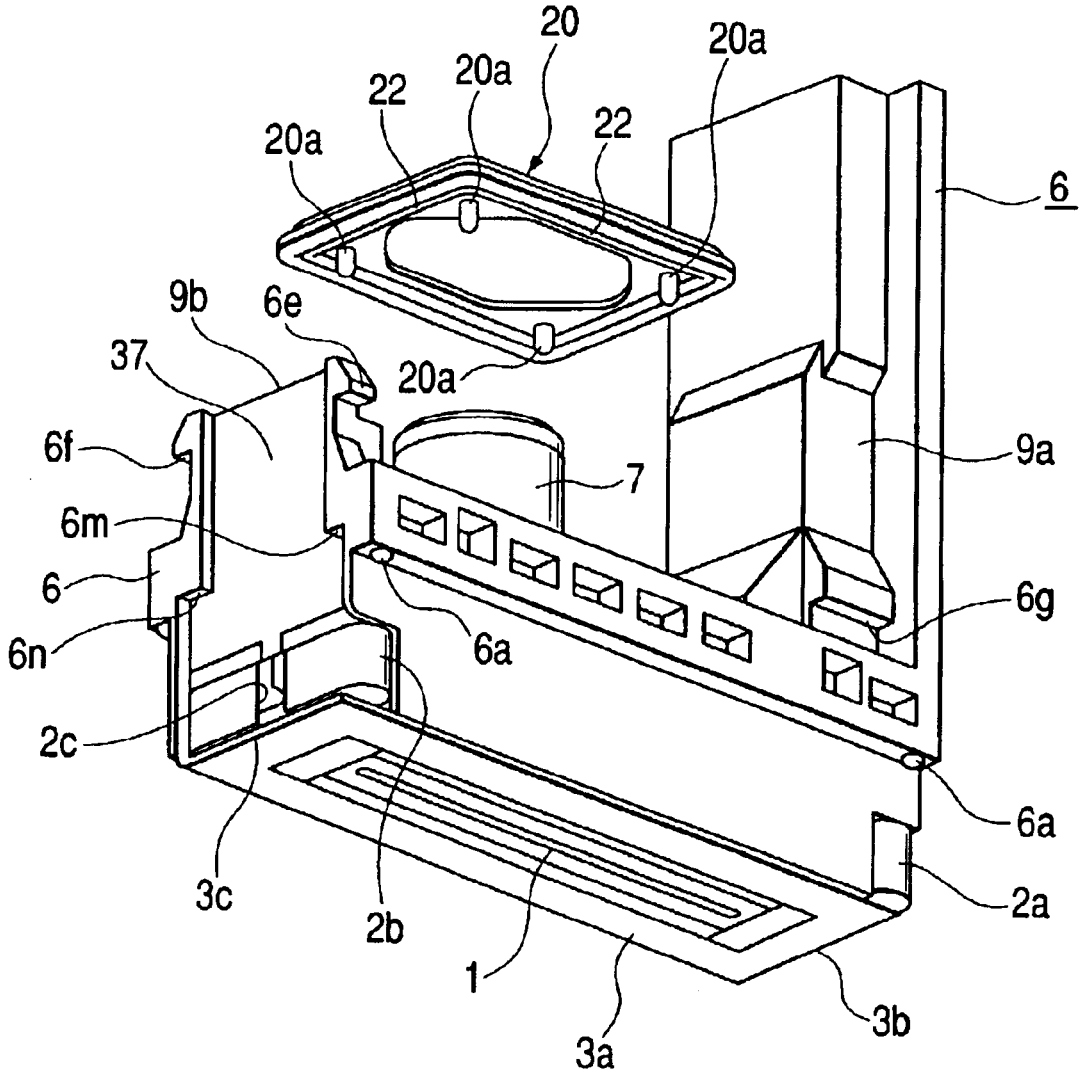
FIG. 5 is a perspective view showing the recording unit when it is viewed from below the flow path-forming member.
Figure 6:
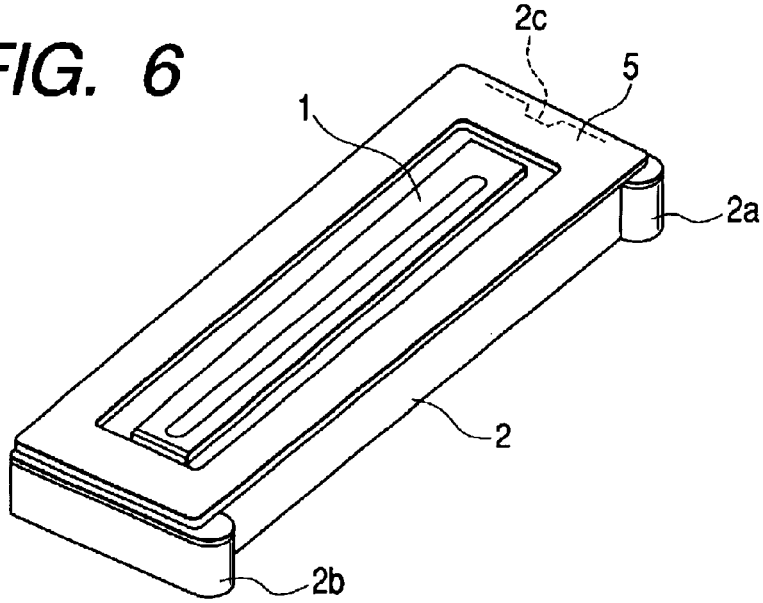
FIG. 6 is a perspective view showing a joint state of a recording element substrate and first and second plates.
Figure 7:
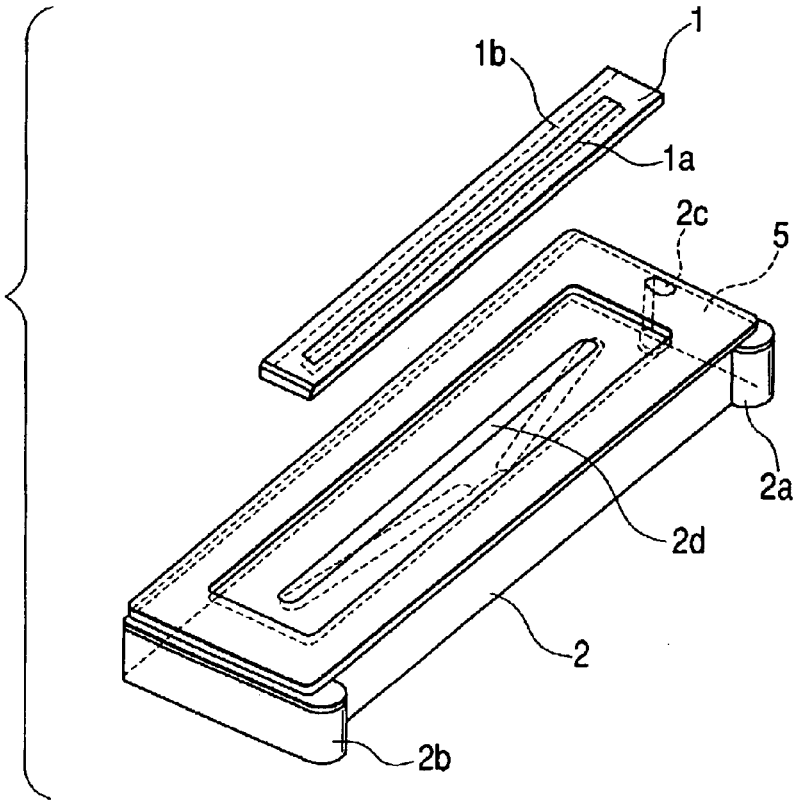
FIG. 7 is an exploded perspective view showing the recording element substrate and the first and second plates.
Figure 8:
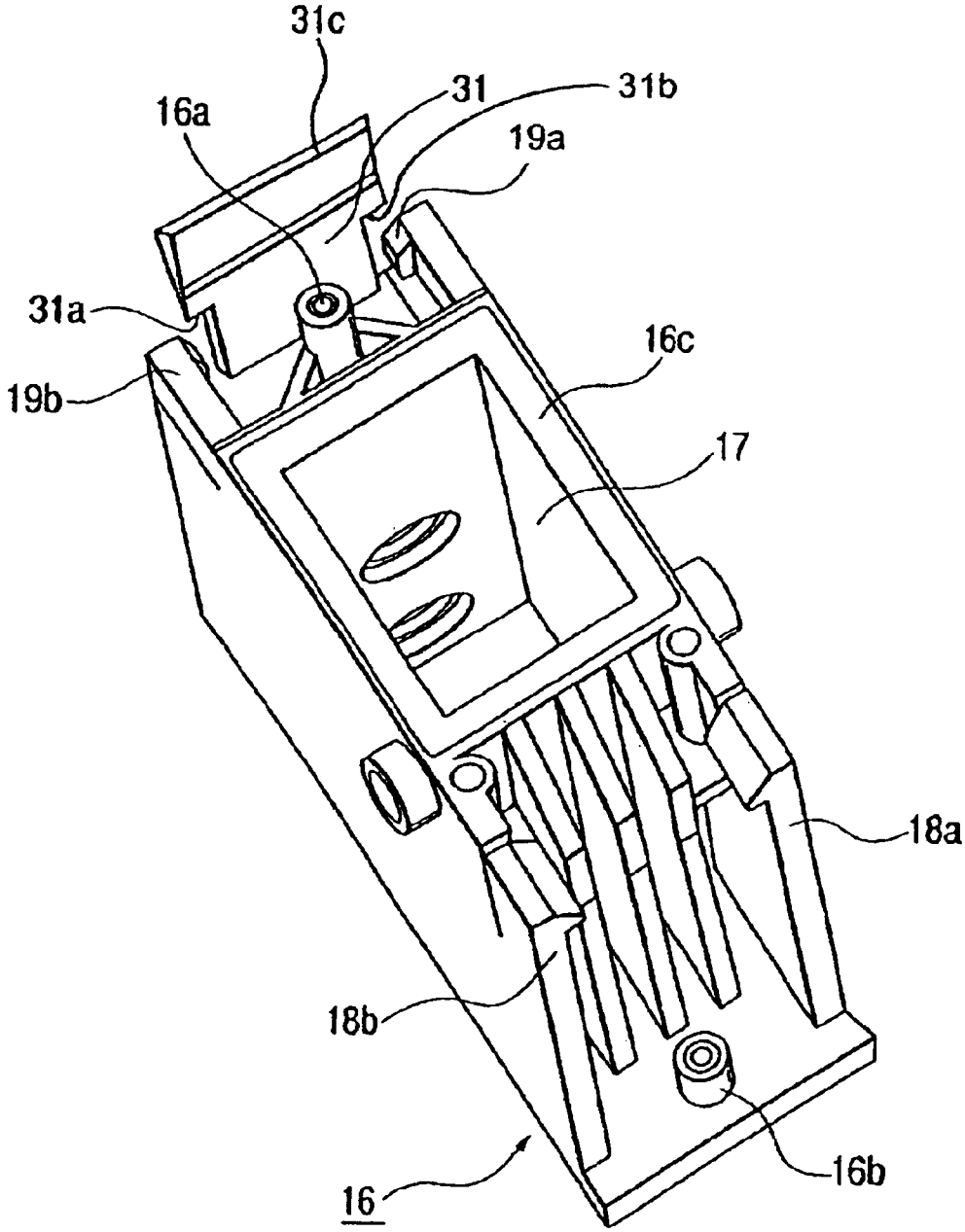
FIG. 8 is a perspective view showing an outside appearance of a frame member when it is viewed from below it.
Figure 9:
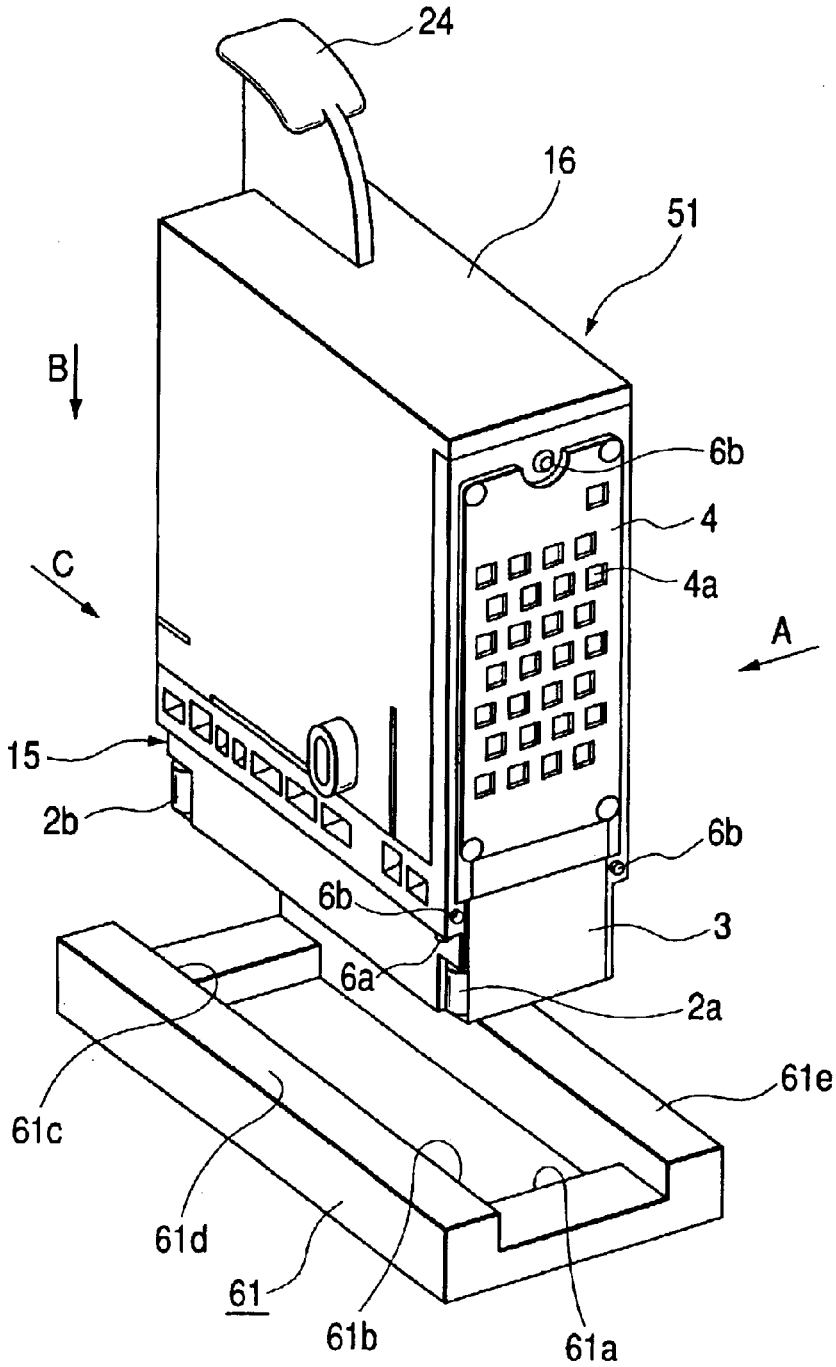
FIG. 9 is a perspective view showing a state in which the liquid jet recording head is mounted on a carriage.
Figure 10:
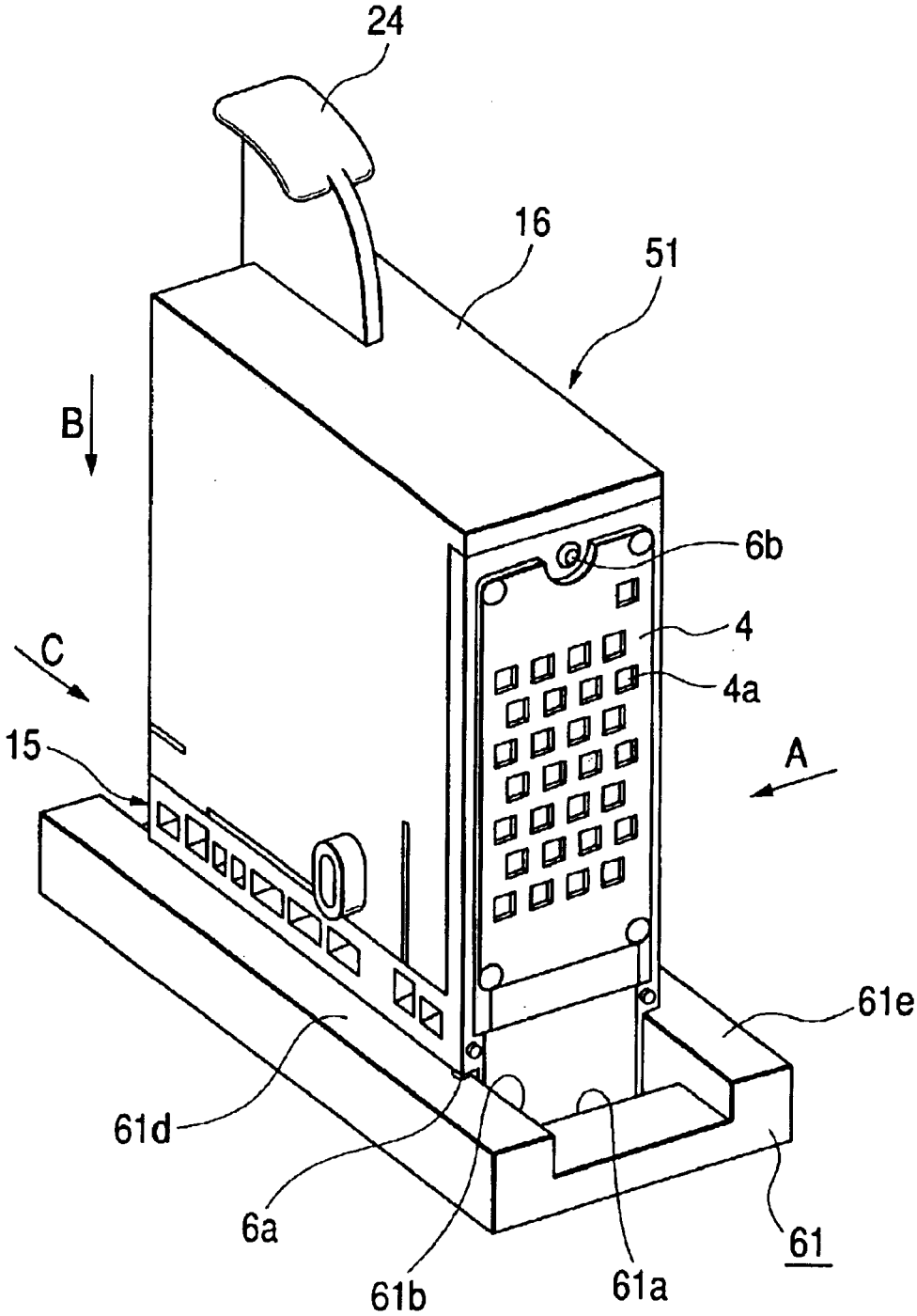
FIG. 10 is a perspective view showing a state in which the liquid jet recording head has been mounted on the carriage.
Figure 11:
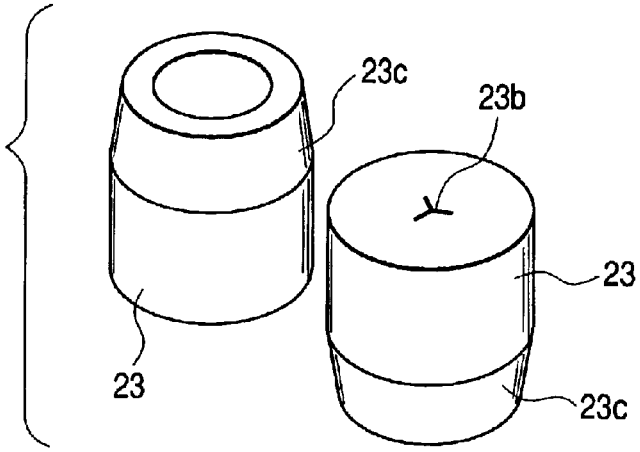
FIG. 11 is a perspective view showing a joint rubber.
Figure 12:
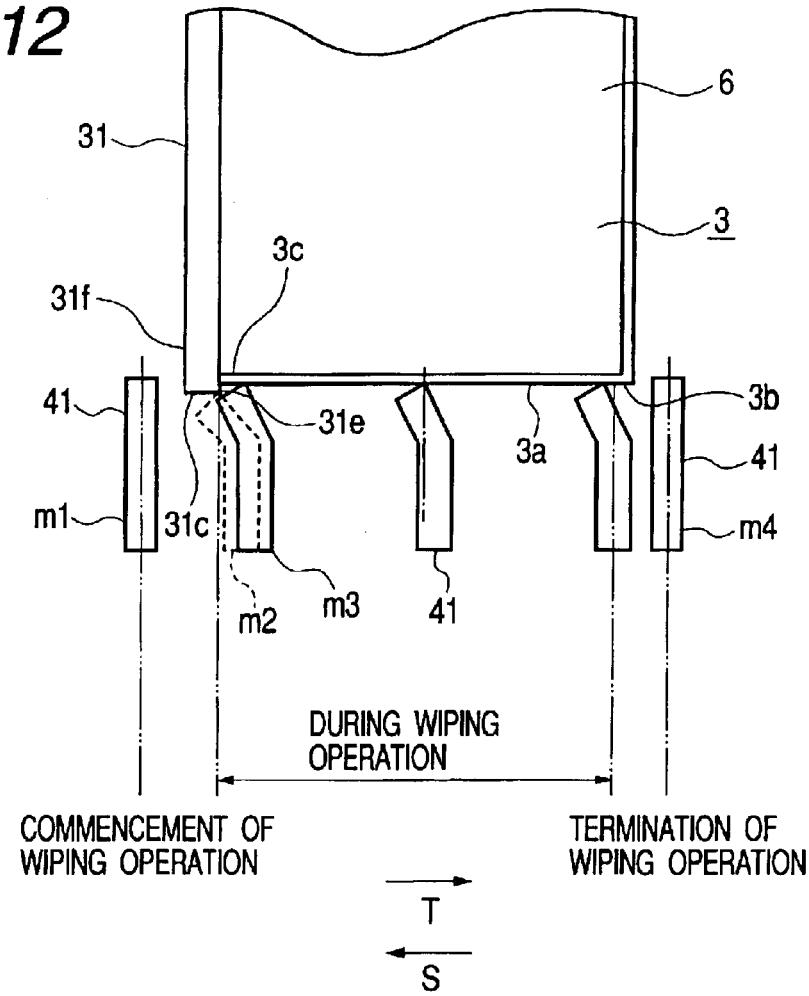
FIG. 12 is a schematic view explaining a wiping operation executed by a blade on a face surface.
Figure 13:
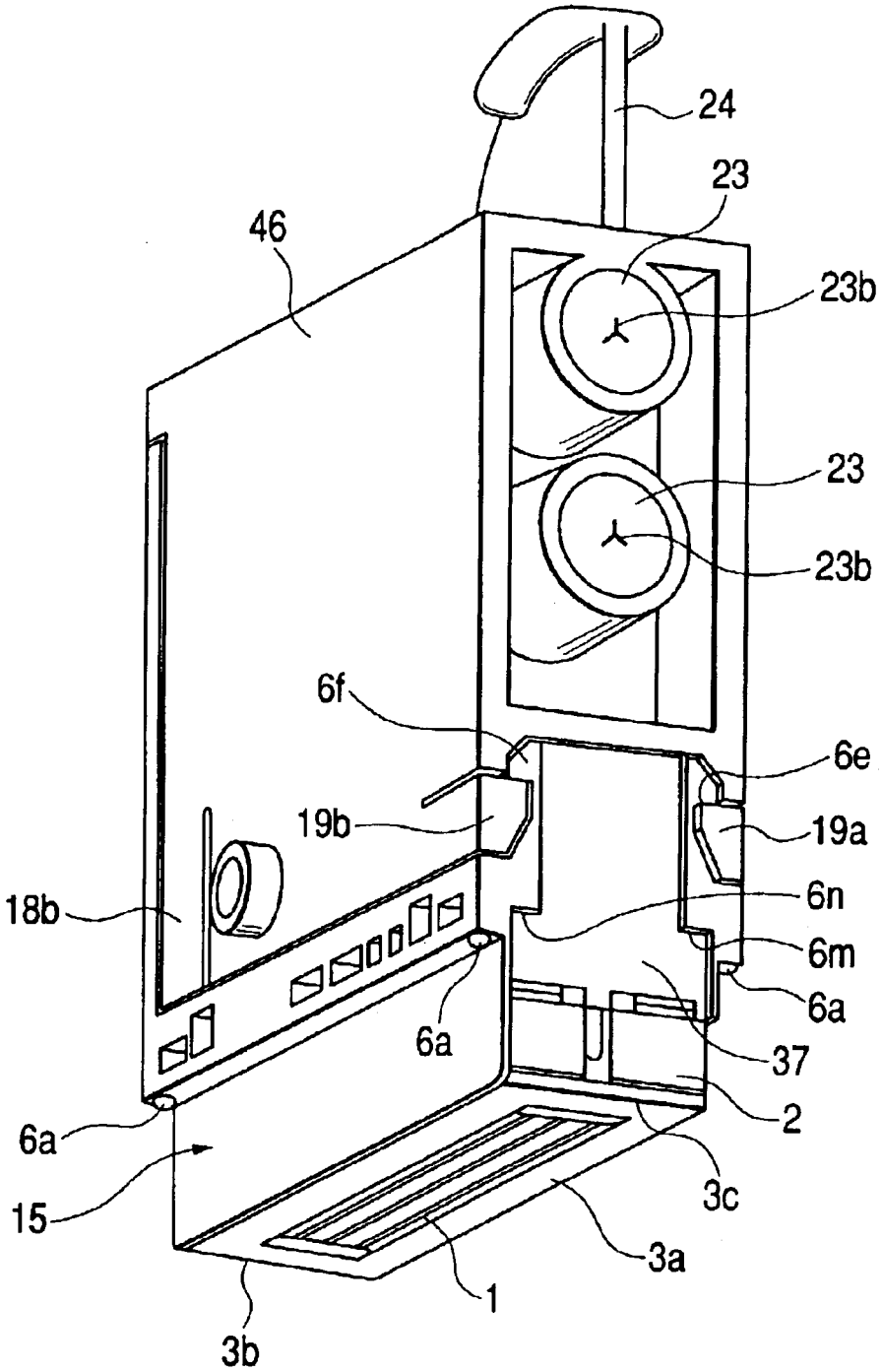
FIG. 13 is a perspective view showing an outside appearance of a liquid jet recording head of a reference example with which another frame member is coupled.

FIGS. 1 and 2 are perspective views showing outside appearances of a liquid jet recording head of a first embodiment, and FIG. 3 is an exploded perspective view showing the liquid jet recording head. FIGS. 4 and 5 are perspective views showing a recording unit, FIG. 6 is a perspective view showing a state of a recording element substrate when it is joined, and FIG. 7 is a perspective view showing the recording element substrate when it is disassembled. FIG. 8 is a perspective view showing an outside appearance of a frame member. FIG. 9 is a perspective view showing a state in which the liquid jet recording head is mounted on a carriage, and FIG. 10 is a perspective view showing a state in which the liquid jet recording head has been mounted on the carriage. FIG. 11 is a perspective view showing a joint rubber, and FIG. 12 is a schematic view explaining a wiping operation of a blade. FIG. 13 is a perspective view showing an outside appearance of a liquid jet recording head of a reference example with which another frame member is coupled.

(First Embodiment)

A liquid jet recording head according to a first embodiment of the invention will be described below with reference to the drawings.

As shown in FIGS. 1, 2, and 3, the liquid jet recording head 51 of the first embodiment includes a recording unit 15 for discharging a recording liquid and recording information on a recording medium and a frame member 16 for accommodating the recording liquid to be supplied to the recording unit 15 and holding the recording unit 15.

While described later in detail, the recording unit 15 roughly includes a liquid droplet discharging section and a wiring sheet composed of flexible cables, TABs and the like acting as electric wirings. The liquid droplet discharging section discharges liquid droplets based on a recording signal from a nozzle row, in which discharge ports (nozzles) for discharging the liquid droplets are formed in a row, and the wiring sheet transmits the recording signal between it and a drive controller (not shown) which a recording apparatus includes. The frame member 16 roughly has a role as a recording liquid storage unit having a recording liquid storing chamber (common liquid chamber) for accommodating the recording liquid and the like to be supplied to the recording unit 15 and a role as a casing for holding the recording unit 15. A so-called cartridge system is employed in the liquid jet recording head 51 so that the liquid jet recording head 51 can be detachably mounted on a carriage which the recording apparatus includes.

An example of an arrangement of the recording unit 15 will be described below with reference to the drawings.

As shown in FIGS. 1 to 7, the recording unit 15 includes a recording element substrate 1, a first plate 2, a wiring sheet 3, a terminal wiring substrate 4, a second plate 5, a flow path-forming member 6, and a porous member 7. The recording element substrate 1 discharges the recording liquid, the first plate 2 acts as a support substrate for supporting the recording element substrate 1, the wiring sheet 3 transmits the recording signal to the recording element substrate 1, an end of the wiring sheet 3 is electrically connected to the terminal wiring substrate 4 so as to be supplied with the recording signal therefrom, the flow path-forming member 6 has a recording liquid supply path for supplying the recording liquid to the recording element substrate 1, and the porous member 7 removes dust and the like in the recording liquid.

The recording element substrate 1 includes a plurality of recording elements for discharging the recording liquid and wirings composed of aluminum and the like for supplying electric power to the respective recording elements, these recording elements and the wirings being formed on one of the surfaces of an Si substrate by film forming processing. The recording element substrate 1 further includes a plurality of recording liquid flow paths corresponding to the recording elements and a plurality of discharge ports (not shown) formed thereon by photolithography processing as well as recording liquid supply ports 1*a* are formed on the back surface of the recording element substrate 1 to supply the recording liquid to the plurality of recording liquid flow paths communicating the discharge ports.

As shown in FIGS. 3, 6, and 7, the first plate 2 has cylindrical surface portions 2*a* and 2*b* formed on a longitudinal side surface at both the ends thereof, respectively. Further, the first plate 2 has a cylindrical groove 2*c* formed on a lateral side surface at the center thereof. After the relative position and the inclination of a plane, on which the recording elements are disposed, of the recording element substrate 1 are adjusted, respectively using a plane connecting the apexes of the cylindrical surface portions 2*a* and 2*b* at the two positions (hereinafter, referred to as a "first reference plane") and the cylindrical groove 2*c* as references, the recording element substrate 1 is placed on and joined to a main surface of the first plate 2. As described above, since the relative position between the recording element substrate 1 and the first plate 2 is set by a semiconductor mounting technology with pinpoint accuracy, the recording unit 15 can be mounted with inclination from the recording element substrate 1 to the plane, on which the recording elements are disposed, reduced to a small amount.

Further, since the first plate 2 is formed in a flat shape, the mounting surface of the recording element substrate 1 and the surface thereof confronting the mounting surface can be formed with pinpoint plane geometrical accuracy, and further a degree of parallelism therebetween can be set with pinpoint accuracy. As a result, while not shown, in a device (not shown) for joining the recording element substrate, a base table, on which the first plate 2 is placed, can be formed in a simple structure, and the first plate 2 can be placed on the base table with pinpoint accuracy. Since the recording element substrate 1 can be more accurately adjusted with respect to the first plate 2 by the above arrangement, the accuracy of the relative inclination of the recording element substrate 1 to the first reference plane of the first plate 2 is more enhanced, thereby the productivity of the liquid jet recording head can be improved. Furthermore, since the first reference plane of the side surface of the first plate 2 is formed in parallel with the longitudinal side surface of the recording element substrate 1, a work observing area of the joint device for jointing the recording element substrate 1 is reduced in size as compared with a case in which the first reference plane is formed perpendicularly to the long side surface. As a result, a job for adjusting the first plate 2 and the recording element substrate 1 can be executed easily, and a working time can be reduced. Moreover, since a space on which the work is placed can be reduced in size, the joint device can be manufactured at a low cost.

In addition, the first plate 2 is formed such that the distance between the apexes of the cylindrical surface portions 2*a* and 2*b* is set longer than the length of the row in which the recording elements of the recording element substrate 1 are disposed. As a result, according to the first plate 2, the inclination of the recording element substrate 1 can be easily adjusted with respect to the first reference plane in the adjustment job, thereby adjustment accuracy is improved, and the recording element substrate 1 can be stably manufactured.

As shown in FIGS. 3 and 7, the first plate 2 has a recording liquid supply path 2*d* formed therethrough which supplies the recording liquid to the recording element substrate 1.

Also, the second plate 5 is bonded and jointed to the first plate 2. The second plate 5 has an opening 5*a* formed on a main surface thereof, and the opening 5*a* avoids the interference of the recording element substrate 1 when it is mounted.

In contrast, the wiring sheet 3 is held with an end thereof joined onto the main surface of the second plate 5 and electrically connected to the recording element substrate 1. Further, the other end of the wiring sheet 3 is electrically connected to the terminal wiring substrate 4 through connection means such as an anisotropic conductive film (ACF), lead bonding, wire bonding, connector and the like.

Note that while the wiring sheet 3 and the terminal wiring substrate 4 are composed of different members as electric wiring means for supplying the recording signal to the recording element substrate 1 in this embodiment, they may be integrally composed of the same member.

The electric wiring means described above is a series of wiring section electrically connecting the wiring sheet 3 to the terminal wiring substrate 4 and applies an electric signal for discharging the recording liquid to the recording element substrate 1.

The terminal wiring substrate 4 is formed in an approximately rectangular and flat shape and has electric wirings (not shown) corresponding to the recording element substrate 1. As shown in FIG. 2, a connecting section is disposed to an end of the terminal wiring substrate 4 in the longitudinal direction thereof, and ends of the electric wirings are electrically connected to an end of the wiring sheet 3 at the connecting section. Further, the terminal wiring substrate 4 has an external signal input terminal 4*a* formed on a main surface thereof, and a recording signal from the drive controller (not shown) of the recording apparatus is input to the external signal input terminal 4*a*. The terminal wiring substrate 4 is positioned on and fixed to a side surface of the flow path-forming member 6.

Further, as shown in FIGS. 4 and 5, the first plate 2 is joined and fixed to the flow path-forming member 6 by joint means, for example, an adhesive, screws and the like. The first plate 2 is connected to the flow path-forming member 6 to thereby cause the recording liquid path of the first plate 2 to communicate with the recording liquid path of the flow path-forming member 6.

Further, the flow path-forming member 6 has spherical positioning bosses 6*a* and 6*b* projecting therefrom to position the liquid jet recording head 51 with respect to a carriage which will be described later. The liquid jet recording head 51 is positioned by the positioning boss 6*a* with respect to the direction of an arrow B in FIG. 4 and positioned by the positioning boss 6*b* with respect to the direction of an arrow C in FIG. 4.

In addition, the flow path-forming member 6 has the porous member 7 jointed to an upper surface 6*k* opposite to a side where the first plate 2 is jointed, and the recording liquid is filtered by the porous member 7. The porous member 7 prevents dust from entering the liquid jet recording head 51 from an upper stream of the recording liquid supply path.

The flow path-forming member 6 has engaging projections 9*a* and 9*b* disposed on the upper surface 6*k* opposite to the side where the first plate 2 is jointed at both the ends in the longitudinal direction thereof and engaged with the frame member 16. Accordingly, the flow path-forming member 6 has the porous member 7 interposed between the engaging projections 9*a* and 9*b* confronting each other.

The flow path-forming member 6 also has a positioning hole 6*c* formed in the vicinity of the engaging projection 9*b*, and the flow path-forming member 6 is positioned with respect to the frame member 16 through the positioning hole 6*c*. Further, the engaging projection 9*b* has a positioning hole 6*d* formed on an upper end surface confronting the frame member 16 and is positioned with respect to the frame member 16 through the positioning hole 6*d*.

Furthermore, the engaging projection 9*a* of the flow path-forming member 6 has first receiving portions 6*h* and 6*g* formed by cutting out it, respectively at both the ends in the lateral direction of the recording element substrate 1, and the frame member 16 is engaged with the first receiving portions 6*h* and 6*g*. Moreover, the engaging projection 9*b* of the flow path-forming member 6 has second receiving portions 6*e* and 6*f* formed by cutting out it, respectively, at both the ends in the lateral direction of the recording element substrate 1, and the frame member 16 is engaged with the second receiving portions 6*e* and 6*f*.

Next, an example of an arrangement of the frame member 16 will be described below with reference to the drawings.

As shown in FIG. 8, the frame member 16 is formed of, for example, a resin material and has a role acting as a casing of the liquid jet recording head 51. The frame member 16 has a common liquid chamber 17 formed therein, and the common liquid chamber 17 stores a predetermined amount of the recording liquid temporarily or until it is exhausted.

The frame member 16 has bosses 16*a* and 16*b* projecting from it integrally therewith, respectively at an end adjacent to the flow path-forming member 6, and the bosses 16*a* and 16*b* are inserted into the positioning holes 6*c* and 6*d* of the flow path-forming member 6.

Further, the frame member 16 has first snap fits 18*a* and 18*b* and second snap fits 19*a* and 19*b* formed thereto at the end adjacent to the flow path-forming member 6 so as to be elastically deformed, and the first snap fits 18*a* and 18*b* and the second snap fits 19*a* and 19*b* are engaged with the engaging projections 9*a* and 9*b* of the flow path-forming member 6.

Also as shown in FIGS. 1 and 8, the frame member 16 has an extending piece 31 formed integrally therewith. The extending piece 31 is positioned in the vicinity of the second snap fits 19*a* and 19*b* and engaged with the engaging projection 9*b* of the flow path-forming member 6. The extending piece 31 extends toward the recording unit 15 to a position corresponding to a lateral side surface of the first plate 2 located on the recording unit 15 side. The extending piece 31 has a distal end portion 31*c* extending to a position where it covers a side end 3*c* of the wiring sheet 3 of the recording unit 15. The distal end portion 31*c* slightly projects beyond a face surface 3*a* of the wiring sheet 3 in a recording liquid discharging direction which is a direction approximately orthogonal to the face surface 3*a* in a state in which the frame member 16 is coupled with the flow path-forming member 6. In other words, the distal end portion 31*c* of the extending piece 31 is located adjacent to the side end 3*c* of the wiring sheet 3 such that an inner wall surface 31*e* of the extending piece 31 faces the outer periphery of the face surface 3*a* in a state in which the frame member 16 is coupled with the flow path-forming member 6, thereby the extending piece 31 acts as a protection wall of the side end 3*c*.

The extending piece 31 is formed in an approximately T-shaped flat shape and has an elastically deforming portion 31*d* at a base end, which can be elastically deformed in a thickness direction. In addition, the extending piece 31 has hooks 31*a* and 31*b* formed by cutting out it on both the sides thereof in a width direction parallel with the lateral direction of the first plate 2, the hooks 31*a* and 31*b* being engaged with the engaging projection 9*b* of the flow path-forming member 6. Further, the engaging projection 9*b* of the flow path-forming member 6 has an engaging recess 37 formed on a side surface facing the outside, the engaging recess 37 being engaged with the extending piece 31. The engaging recess 37 has third receiving portions 6*m* and 6*n* formed on side walls, respectively, the third receiving portions 6*m* and 6*n* being engaged with the hooks 31*a* and 31*b* of the extending piece 31.

The frame member 16 has a grip 24 projecting from it integrally therewith on an outer periphery on the side opposite to the side where the recording unit 15 is disposed, and the grip 24 is used to hold the liquid jet recording head 51. The grip 24 acts as means through which the liquid jet recording head 51 is mounted on and dismounted from the carriage provided with the recording apparatus.

The frame member 16 is positioned with respect to the flow path-forming member 6 when the bosses 16*a* and 16*b* are inserted into the positioning holes 6*c* and 6*d* of the flow path-forming member 6. Further, the frame member 16 is coupled with and fixed to the flow path-forming member 6 when the first snap fits 18*a* and 18*b* and the second snap fits 19*a* and 19*b* are engaged with the first receiving portions 6*g* and 6*h* and the second receiving portions 6*e* and 6*f* of the engaging projections 9*a* and engaging projection 9*b* of the flow path-forming member 6, respectively as well as the hooks 31*a* and 31*b* of the extending piece 31 of the frame member 16 are engaged with the third receiving portions 6*m* and 6*n*.

The hooks 31*a* and 31*b* of the extending piece 31 are engaged with the third receiving portions 6*m* and 6*n* of the flow path-forming member 6 as described above. Thus, even if an external force acts on the extending piece 31 in a direction where it is separated from the wiring sheet 3, a friction resistance generated by the engagement of the hooks 31*a* and 31*b* with the third receiving portions 6*m* and 6*n* prevents the elastically deforming portion 31*d* of the extending piece 31 from being bending-deformed in a direction where the engaged state of the extending piece 31 with the wiring sheet 3 is broken.

Accordingly, while the length of the elastically deforming portion 31*d* of the extending piece 31 is increased and the bending rigidity of the elastically deforming portion 31*d* is reduced by disposing the extending piece 31 to the frame member 16, the size of the liquid jet recording head 51 can be reduced in its entirety because the engaged state is not easily broken even if the elastically deforming portion 31*d* has the small thickness.

Note that the extending piece 31 described above is disposed to the frame member 16. If, however, the extending piece 31 is disposed to the flow path-forming member 6, while not shown, the extending piece 31 acts as an obstacle when the wiring sheet 3 is moved to the flow path-forming member 6 in a process for adhering the wiring sheet 3. Accordingly, in this case, the wiring sheet 3 must be adhered onto the second plate 5 before the flow path-forming member 6 is joined. As described above, the arrangement, in which the extending piece 31 is disposed to the flow path-forming member 6, is not preferable because productivity is deteriorated thereby.

Further, the distal end portion 31*c* of the extending piece 31 projects beyond the face surface 3*a*. Thus, when, for example, a recording sheet having a relatively easily curling habit passes through the recording apparatus or when clogged recording sheet removal processing is executed, even if the recording sheet tends to come into contact with the discharge ports, it is prevented from coming into contact with the discharge ports because the distal end portion 31*c* of the extending piece 31 comes into contact with the recording sheet. Accordingly, the extending piece 31 can avoid a disadvantage in that the periphery of the discharge ports and the face surface 3*a* are damaged by the recording sheet and that the quality of data recorded on the recording sheet is deteriorated.

Further, the liquid jet recording head 51 includes a seal member 20 for hermetically sealing the portions where recording fluid flow paths are coupled between the frame member 16 and the flow path-forming member 6. The seal members 20 is formed of an elastic member, for example, rubber, elastomer and the like in a frame shape and has an upper rib 21 formed on an upper surface facing the frame member 16 and a lower rib 22 formed on a lower surface facing the flow path-forming member 6 as shown in FIGS. 4 and 5, these upper and lower ribs 21 and 22 being formed by being raised from the seal member 20 integrally therewith along the outer periphery thereof.

Further, the seal member 20 has positioning bosses 20*a* disposed at the four corners of the lower surface confronting the upper surface 6*k* of the flow path-forming member 6, respectively so that the seal member 20 is positioned with respect to and engaged with the upper surface 6*k* through the positioning bosses 20*a*. Further, the flow path-forming member 6 has positioning holes 6*j* formed on the upper surface 6*k* along the outer periphery of the porous member 7 so that the respective positioning bosses 20*a* of the seal member 20 are engaged with the positioning holes 6*j*.

After the respective positioning bosses 20*a* have been inserted into the respective positioning holes 6*j* of the flow path-forming member 6 and positioned therein, the frame member 16 is assembled on the flow path-forming member 6. As a result, the seal member 20 crushed because the upper rib 21 on the upper surface and the lower rib 22 on the lower surface are clamped between and pressed by a lower surface 16*c* of the frame member 16 and the upper surface 6*k* of the flow path-forming member 6, thereby the interior of the common liquid chamber 17 can be perfectly sealed.

With the above arrangement, in the liquid jet recording head 51, the recording liquid stored in the common liquid chamber 17 of the frame member 16 is supplied to the recording unit 15 and further is supplied to the discharge ports of the recording element substrate 1 from the porous member 7 through the recording liquid paths of the flow path-forming member 6 and the first plate 2 and through a recording liquid supply port 1*b* of the recording element substrate 1. Further, the frame member 16 has joint rubbers 23 acting as recording liquid supply ports for supplying the recording liquid to the common liquid chamber 17. As shown in FIG. 11, each of the joint rubbers 23 has a cracked hole 23*b* having Y-shaped slits and formed on an end surface at the center thereof. As shown in FIG. 3, the joint rubbers 23 are forcibly inserted into cylindrical holes 16*s* of the frame member 16, the cylindrical holes 16*s* having an inside diameter smaller than the outside diameter of the joint rubbers 23. In addition, a distal end portion 23*c* on the side of each joint rubber 23, from which the joint rubber 23 is forcibly inserted into the frame member 16, is formed in a taper shape having a diameter gradually reduced toward a distal end so that the joint rubber 23 can be easily inserted into the cylindrical hole 16*s*.

When recording liquid supply needles (not shown) of a recording liquid supply mechanism of the recording apparatus are inserted into the common liquid chamber 17 in the frame member 16, the cracked holes 23*b* formed in the joint rubbers 23 as described above permit the liquid supply needles to be easily inserted thereinto because the cracked holes 23*b* are broken by the distal ends of the needles. Further, when the needles are not inserted into the cracked holes 23*b*, they are sealed by a compression load applied thereto from the outer peripheries of the joint rubbers 23, thereby the interior of the common liquid chamber 17 can be kept in a hermetically sealed state.

In contrast, when the needles are inserted into the cracked holes 23*b*, the joint rubbers 23 apply a grip force to the needles by compressing them from the outer peripheries thereof, thereby joint portions (not shown) on the outer peripheral sides of the needles can be perfectly hermetically sealed.

The joint rubbers 23 are disposed vertically side by side at two positions on a side of the frame member 16. A lower joint rubber 23 is used as a supply path for supplying the recording liquid from a recording liquid storing tank (not shown), which the recording apparatus includes, and the recording liquid is supplied into the common liquid chamber 17 through a lower needle. Further, an upper joint rubber 23 is used as an air intake path for discharging the air stored in the common liquid chamber 17 to the outside thereof and making the interior of the common liquid chamber 17 to a negative pressure. Accordingly, the negative pressure in the common liquid chamber 17 is controlled by discharging the air in the common liquid chamber 17 from the needle inserted into the upper joint rubber 23 to the outside of the common liquid chamber 17 by air intake drive means (not shown) such as a pump and the like.

That is, an amount of the recording liquid to be replenished into the common liquid chamber 17 can be controlled by increasing the negative pressure in the common liquid chamber 17 through the air intake path.

Next, a state in which the flow path-forming member 6 of the recording unit 15 is coupled with the frame member 16 will be described in more detail.

The respective recording liquid flow paths of the frame member 16 and the flow path-forming member 6 are hermetically sealed, and the frame member 16 perfectly communicates with and fixed to the flow path-forming member 6 by inserting the boss 16*a* of the frame member 16 into the positioning hole 6*c* of the flow path-forming member 6, by inserting the boss 16*b* of the frame member 16 into the positioning hole 6*d* of the flow path-forming member 6, by engaging the first snap fits 18*a* and 18*b* of the frame member 16 with the first receiving portions 6*g* and 6*h* of the flow path-forming member 6, by engaging the second snap fits 19*a* and 19*b* of the frame member 16 with the second receiving portions 6*e* and 6*f* of the flow path-forming member 6, by engaging the hooks 31*a* and 31*b* of the extending piece 31 of the frame member 16 with the third receiving portion 6*m* and 6*n* of the flow path-forming member 6, and further by clamping the seal member 20 between the frame member 16 and the flow path-forming member 6 confronting each other so that the seal member 20 comes into pressure contact therewith.

Accordingly, in the liquid jet recording head 51 of this embodiment, jobs for assembling and disassembling the recording unit 15 and the frame member 16 can be more easily executed as compared with a mode in which the recording unit 15 is coupled with the frame member 16 by screws, an adhesive and the like and with a mode in which the portion where they are coupled with each other is hermetically sealed through a seal agent and the like. Thus, the arrangement of the liquid jet recording head 51 is suitable for recycling, and the liquid jet recording head 51 can be manufactured at a low cost.

Further, the first snap fits 18*a* and 18*b* have a pair of hooks that confront each other and are disposed at confronting positions in a direction where they are engaged with the first receiving portions 6*g* and 6*h*. Likewise, the second snap fits 19*a* and 19*b* have a pair of hooks which confront each other and are disposed at confronting positions in a direction where they are engaged with the second receiving portions 6*e* and 6*f*. With this arrangement, the first snap fits 18*a* and 18*b* and the second snap fits 19*a* and 19*b* are firmly engaged with the first receiving portions 6*g* and 6*h* and the second receiving portions 6*e* and 6*f* through the respective hooks. In addition, the first snap fits 18*a* and 18*b* have elastically deforming portions formed such that the longitudinal direction thereof is in agreement with a coupling direction in which the frame member 16 is coupled with the flow path-forming member 6. Also, the second snap fits 19*a* and 19*b* have elastically deforming portions formed such that the longitudinal direction-thereof is orthogonal to the coupling direction of the frame member 16 and the flow path-forming member 6. That is, the fist snap fits 18*a* and 18*b* and the second snap fits 19*a* 11 19*b* are formed such that when the frame member 16 is coupled with the flow path-forming member 6, the respective elastically deforming portions thereof are elastically deformed in directions orthogonal to each other.

With this arrangement, when the liquid jet recording head 51 is dropped by mistake and an impulsive force is applied thereto in a direction where the frame member 16 is uncoupled and separated from the flow path-forming member 6, tensile stress acts in the longitudinal direction of the elastically deforming portions of the first snap fits 18*a* and 18*b*. However, the first snap fits 18*a* and 18*b* have rigidity sufficiently withstanding the tensile stress. Accordingly, the hooks of the first snap fits 18*a* and 18*b* are not disengaged from the first receiving portions 6*g* and 6*h* by an impulsive load acting on the elastically deforming portions in the longitudinal direction thereof.

Further, since the frame member 16 is coupled with the flow path-forming member 6 while compressing and clamping the seal member 20 therebetween, a repulsive force is applied at all times by the elastic force of the seal member 20 in a direction where the frame member 16 is separated from the flow path-forming member 6. Accordingly, the elastically deforming portions of the first snap fits 18*a* and 18*b* have a mechanical strength having a tensile strength capable of sufficiently withstanding the repulsive force of the seal member 20. Likewise, the elastically deforming portion 31*d* of the extending piece 31 also has a mechanical strength having a tensile strength capable of withstanding the repulsive force of the seal member 20.

Additionally, the first snap fits 18*a* and 18*b* are engaged the first receiving portions 6*g* and 6*h* in a state in which the engaging surfaces of the hooks are abutted against the first receiving portions 6*g* and 6*h* approximately horizontally (in parallel therewith). Accordingly, the portion where the frame member 16 is coupled with the flow path-forming member 6 is positioned with pinpoint accuracy because the hooks are abutted against the first receiving portions 6*g* and 6*h*. In contrast, when an impulsive force is applied in a direction where the frame member 16 is separated from the flow path-forming member 6, bending stress is applied to the elastically deforming portions of the second snap fits 19*a* and 19*b* at the portion where the second snap fits 19*a* and 19*b* are engaged with the second receiving portions 6*e* and 6*f*. The second snap fits 19*a* and 19*b* are not disengaged from the second receiving portions 6*e* and 6*f* by the bending stress. However, since the second snap fits 19*a* and 19*b* are relatively less rigid to the bending stress, when a large load is applied to the second snap fits 19*a* and 19*b*, they are bending-deformed.

Moreover, since the repulsive force generated by the seal member 20 is always applied to the portion where the frame member 16 is coupled with the flow path-forming member 6 as described above, there is a possibility that the frame member 16 and the flow path-forming member 6 are moved in a direction where they are separated from each other by the occurrence of plastic deformation due to the bending deformation, thereby the positioning accuracy of the relative position between the frame member 16 and the flow path-forming member 6 is deteriorated.

That is, the first snap fits 18*a* and 18*b* and the extending piece 31 have withstanding loads larger than those of the second snap fits 19*a* and 19*b* with respect to the repulsive force generated by the elasticity of the seal member 20. Accordingly, the hooks of the first snap fits 18*a* and 18*b* and the hooks 31*a* and 31*b* of the extending piece 31 mainly resist the repulsive force generated by the seal member 20, thereby the coupling state of the frame member 16 with the recording unit 15 is maintained.

Therefore, the extending piece 31 is disposed in the vicinity of the second snap fits 19*a* and 19*b* so that the engaging strength of the hooks 31*a* and 31*b* engaged with the third receiving portions 6*m* and 6*n* supplement can supplement the weakness of the engaging strength of the second snap fits 19*a* and 19*b* in the direction where the recording unit 15 is separated from the frame member 16.

Next, a case will be described in which an impulsive force is applied to the first snap fits 18*a* and 18*b* and the second snap fits 19*a* and 19*b* in the elastically deforming direction thereof.

When the impulsive force is applied in the elastically deforming direction, bending stress is applied to the elastically deforming portions of the first snap fits 18*a* and 18*b*, and they are easily bending-deformed. If the hooks of the first snap fits 18*a* and 18*b* are almost disengaged from the first receiving portions 6*g* and 6*h*, the engaging surfaces of the hooks are abutted against the corners of the first receiving portions 6*g* and 6*h* in an inclined attitude, and the friction resistance of the hooks is increased in this abutment state. Thus, it is difficult for the first snap fits 18*a* and 18*b* to return to a predetermined engaging position unless the elastic recovery force of the first snap fits 18*a* and 18*b* has a large load which resists the frictional resistance. When an impulsive load is further applied to the first snap fits 18*a* and 18*b* in the above state, the engaging surfaces of the hooks retract in a direction where they are more separated from the first receiving portions 6*g* and 6*h*, thereby the first snap fits 18*a* and 18*b* are disengaged from the first receiving portions 6*g* and 6*h*.

In contrast, at the positions where the second snap fits 19*a* and 19*b* are engaged with the second receiving portions 6*e* and 6*f*, the elastically deforming portions of the second snap fits 19*a* and 19*b* are bending-deformed, similarly to the positions where the first snap fits 18*a* and 18*b* are engaged with the first receiving portions 6*g* and 6*h*. At this time, however, the engaging surfaces of the hooks of the second snap fits 19*a* and 19*b* are abutted against the second receiving portions 6*e* and 6*f* approximately horizontally (in parallel therewith). As a result, even if the second snap fits 19*a* and 19*b* are bending-deformed, the angle at which the second snap fits 19*a* and 19*b* are abutted against the second receiving portions 6*e* and 6*f* is almost unchanged. As a result, even if the engaging surfaces of the hooks of the second snap fits 19*a* and 19*b* are moved by the bending deformation, a relatively small frictional resistance is applied to the engaging surfaces, thereby the second snap fits 19*a* and 19*b* can instantly return to a predetermined engaging position.

That is, as described above, the liquid jet recording head 51 is arranged such that the frame member 16 is engaged with the flow path-forming member 6 through the first snap fits 18*a* and 18*b* and the second snap fits 19*a* and 19*b* whose elastically deforming portions extend in the different directions. Thus, when the liquid jet recording head 51 receives an impulsive load acting in the direction where the frame member 16 is coupled with the flow path-forming member 6, the first snap fits 18*a* and 18*b* and the extending piece 31 act to maintain the engaged state of the frame member 16 and flow path-forming member 6. In contrast, when the liquid jet recording head 51 receives an impulsive load acting in a direction where the hooks of the first snap fits advance and retract, the second snap fits 19*a* and 19*b* act to maintain the engaged state thereof.

Further, the accuracy of the position where the frame member 16 is coupled with the flow path-forming member 6 is mainly determined by the engagement of the first snap fits 18*a* and 18*b*, which have a tensile strength capable of withstanding a load acting in a direction where the frame member 16 is separated from the flow path-forming member 6, with the first receiving portions 6*g* and 6*h* corresponding thereto, thereby the relative location of the frame member 16 and the flow path-forming member 6 can be maintained with pinpoint accuracy.

In contrast, when the liquid jet recording head 51 receives an impulsive load acting in a direction where the hooks of the first snap fits 18*a* and 18*b* are elastically deformed, the engaged state of the first snap fits 18*a* and 18*b* with the first receiving portions 6*g* and 6*h* is maintained by the engaged state of the second snap fits 19*a* and 19*b* with the second receiving portions 6*e* and 6*f* because the second snap fits 19*a* and 19*b* are not easily disengaged from the second receiving portions 6*e* and 6*f*.

Note that there is also a method of increasing the bending rigidity of the elastically deforming portions of the snap fits by increasing the thickness of the elastically deforming portions as another means for improving the durability of the snap fits to the dropping impulsive force and the repulsive force generated by the seal member 20 described above. In this method, however, the snap fits are increased in size and a space where the frame member 16 is coupled with the flow path-forming member 6 is also increased thereby. Moreover, in the above method, a load necessary to couple the frame member 16 with the flow path-forming member 6 in assembly is increased an increase in the bending rigidity of the snap fits, thereby an assembly job cannot be conveniently executed. Accordingly, in this embodiment, since the frame member 16 can be firmly coupled with the flow path-forming member 6 without increasing the thickness of the elastically deforming portions of the first and second snap fits 18*a* and 18*b* and 19*a* and 19*b*, the liquid jet recording head 51 can be manufactured compactly at a relatively low manufacturing cost. Moreover, this embodiment is excellent in productivity because a load applied when the frame member 16 is coupled with the flow path-forming member 6 is small.

Next, a wiping operation for cleaning the liquid jet recording head 51 arranged as described above will be described. Note that a recording apparatus according to this embodiment provided with the liquid jet recording head 51 described above will be described later.

In the recording apparatus, the recording liquid may be attached in a wet state to the discharge ports and a recording liquid discharge surface 1*b* of the recording element substrate 1 and further to the face surface 3*a* of the wiring sheet 3 due to mists and satellites generated when the recording liquid is discharged from the liquid jet recording head 51. Further, in the recording apparatus, when the recording liquid is sucked from the discharge ports by capping it with a cap of the recovery unit which will be described later, the recording liquid which is not sucked and remains may be attached to the recording liquid discharge surface 1*b* and the face surface 3*a*.

To cope with the above problem, the recording apparatus includes the recovery unit (not shown) for executing the wiping operation to remove the remaining recording liquid attached to the recording liquid discharge surface 1*b* and to the face surface 3*a*.

The recovery unit includes a blade 41 and a transfer mechanism (not shown) for transferring the blade 41, the blade 41 coming into sliding contact with the recording liquid discharge surface 1*b* of the liquid jet recording head 51 and with the face surface 3*a* and wiping the recording liquid. Also, the recovery unit includes a cap for covering the recording liquid discharge surface 1*b* of the liquid jet recording head 51 and the face surface 3*a*, a moving mechanism for moving the cap with respect to the recording unit 15, and a suction mechanism for sucking the recording liquid through the cap.

The blade 41 is formed of an elastic material, for example, rubber, elastomer and the like in an approximately flat shape and has an elastic recovery force for recovering its original shape, when the distal end thereof is elastically deformed, by an elastic force.

Further, when the blade 41 has a width larger than the lateral width of the wiring sheet 3, it can effectively execute the wiping operation because there is no region with which the blade 41 cannot come into sliding contact. Accordingly, it is preferable that the width of the blade 41 be formed larger than the width of the wiring sheet 3.

In FIG. 12, reference numerals $m_1$, $m_2$, $m_3$, and $m_4$ show respective states of the blade 41, that is, commencement of the wiping operation executed by the blade 41, a period during which the blade 41 passes through the distal end portion 31*c* of the extending piece 31, a period during which the wiping operation is executed by the blade 41 (the blade 41 starts to enter the face surface 3*a*) and termination of the wiping operation.

The blade 41 moves in the direction of an arrow T in FIG. 12 from a wiping operation start position (state $m_1$), and when the distal end of the blade 41 comes into contact with the outer wall surface of the extending piece 31, the blade 41 moves in sliding contact with the distal end portion 31*c* of the extending piece 31 with its distal end greatly curved along the distal end portion 31*c* and elastically deformed (state $m_2$).

When the blade 41 further advances in the direction of the arrow T, the distal end thereof comes onto the face surface 3*a* of the wiring sheet 3 (state $m_3$). The face surface 3*a* of the wiring sheet 3 is located at a position, retracted from the distal end portion 31*c* of the extending piece 31 to the flow path-forming member 6 side. Thus, when the distal end of the blade 41 has passed through the distal end portion 31*c* of the extending piece 31, the blade 41 instantly reduces an amount of deformation of the curved shape thereof along a step (a difference between the relative positions of the distal end portion 31*c* of the extending piece 31 and the face surface 3*a*) by means of its elastic recovery force and moves on the face surface 3*a* in sliding contact therewith.

As described above, when the sliding contact surface of the blade 41 at the distal end thereof moves from the distal end portion 31*c* of the extending piece 31 to the face surface 3*a*, since the distal end of the blade 41 tends to return to a flat upright state by means of its elastic recover force, the distal end of the blade 41 vigorously moves in the transfer direction thereof.

At this time, since the distal end of the blade 41 passes through a side end 3*c* of the wiring sheet 3 while jumping across it without coming into contact therewith, the distal end can be securely prevented from being caught by the side end 3*c* of the wiring sheet 3. That is, according to the liquid jet recording head 51 of this embodiment, a disadvantage, in which the wiring sheet 3 is exfoliated from the side end 3*c* by the wiping operation of the blade 41, is not arisen, thereby breakage of the wiring sheet 3 can be prevented. Further, a recording liquid storage unit in which the extending piece 31 is not directly disposed to the recording unit side different from the present invention but detachably disposed to a recording unit or a holder member to which the extending piece 31 is disposed, are preferable because the recording unit does not directly receive the abutment force of the blade 41. That is, the above arrangements are preferable in durability because a force is not directly applied to the wiring sheet 3 and the recording element substrate 1. Furthermore, in the present invention, the extending piece 31 also has a function as an engagement portion when the recording unit is mounted and dismounted, which is preferable from a viewpoint of reducing the size of the recording head. Since the extending piece 31 covers the side end 3*c* of the flow path-forming member 6 and thus covers the cylindrical surface portion 2*b* and the cylindrical groove 2*c* so that they can be protected from ink, thereby it is possible to maintain a system as a positioning reference.

Note that the length of a region, in which the blade 41 jumps the side end 3*c* as described above, is determined by the material of the blade 41 (elasticity recovering force), the moving speed of the blade 41, the difference between the relative positions of the distal end portion 31*c* of the extending piece 31 and the face surface 3*a* (step) of the wiring sheet 3, and the like.

Further, in the liquid jet recording head 51 of this embodiment, since the step between the distal end portion 31*c* of the extending piece 31 and the face surface 3*a* is set to about 1 mm or less, the distal end of the blade 41 is elastically deformed naturally and preferably, and the distal end can be elastically deformed and changed smoothly in a short time.

In the liquid jet recording head 51 arranged as described above, when the blade 41 comes onto the face surface 3*a* of the wiring sheet 3, the blade 41 jumps across the inner wall surface 31*e* of the extending piece 31 and the side end 3*c* of the wiring sheet 3. However, the distal end of the blade 41 keeps the curved shape even after the blade 41 jumps across them. Thus, the blade 41 is instantly pressed against the face surface 3*a* of the wiring sheet 3 from the landing point of the distal end thereof, thereby the wiping operation can be promptly started.

Accordingly, in the liquid jet recording head 51, the dust and the recording liquid attached to the periphery of the discharge ports can be also scraped by the distal end of the blade 41 with reliability. When the blade 41 has entirely passed through the face surface 3*a* of the wiring sheet 3, the blade 41 returns to the shape of its original upright state by its elastic recovery force (state $m_4$).

Since the face surface 3*a* of the wiring sheet 3 and the periphery of the discharge ports are cleaned by a series of the wiping operation described above, the recording apparatus can obtain a good image by stably injecting the recording liquid. Further, since the inner wall surface 31*e* of the extending piece 31 is located upstream of the wiping operation start point, the recording liquid carried by the distal end of the blade 41 does not stay in the vicinity of the inner wall surface 31*e*.

Note that, as a matter of course, a wall, a projection and the like, which project beyond the face surface 3*a*, are not provided in the periphery of the wiring sheet 3 except the distal end portion 31*c* of the extending piece 31 in order to prevent the remaining recording liquid, which flew in the width direction of the blade 41 and could not be removed in the wiping operation, the remaining recording liquid, which could not be removed by the wiping operation executed once, and the like from staying in a region apart from the sliding contact region of the blade 41.

Further, it is preferable that the width of the extending piece 31 be made larger than the width of the blade 41 and that the blade 41 comes into contact with the extending piece 31 in the entire region of the width thereof so that the blade 41 is elastically deformed in a uniformly curved shape in the entire region thereof in a width direction when the distal end of the blade 41 comes into contact with the extending piece 31 and is curved.

FIG. 13 shows an arrangement of a liquid jet recording head 52 of a reference example in which a wiping operation is executed from a bending portion 3*b* of a wiring sheet 3 to a front surface of the liquid jet recording head 52 (in the direction of the arrow S in FIG. 12) and which is mounted on, for example, a serial type recording apparatus. Note that, in FIG. 13, the same components as those of the liquid jet recording head 51 described above are denoted by the same reference numerals and the description thereof is omitted for the sake of convenience.

In other words, the liquid jet recording head 52 is arranged such that a recording unit 15 is coupled with a frame member 46 to which the extending piece 31 of the frame member 16 described above is not attached. As described above, the recording unit 15 is arranged as a common module and selectively coupled with any one of the frame member 16 to which the extending piece 31 is attached and the frame member 46 to which the extending piece 31 is not attached. With this arrangement, two types of liquid jet recording heads, which are mounted on recording apparatuses each having a different wiping direction, can be manufactured at a low cost.

Next, a positioning method of positioning the liquid jet recording head 51 with respect to the carriage attached to the recording apparatus will be described with reference to FIGS. 9 and 10.

FIGS. 9 and 10 do not show the carriage in its entirety but schematically show only a part of the bottom surface of it for the sake of convenience of description.

The bottom surface of the carriage has an opening 61*a* formed thereon, and the liquid jet recording head 51 is inserted into the carriage through the opening 61*a*. Receiving portions 61*b* and 61*c* are disposed on an inner wall surface of the opening 61*a* to receive the cylindrical surface portions 2*a* and 2*b* of the liquid jet recording head 51, and the upper surface of the carriage has receiving surfaces 61*d* and 61*e* formed thereon, the receiving surfaces 61*d* and 61*e* supporting the insertion direction of the liquid jet recording head 51.

When the liquid jet recording head 51 is lowered onto the bottom surface 61 of the carriage and inserted into the carriage, the liquid jet recording head 51 is pressed in the directions of arrows A, B, and C of FIG. 9 by presser means (not shown) disposed to the carriage side. Accordingly, the positioning bosses 6*a* of the liquid jet recording head 51 are abutted against the receiving surfaces 61*d* and 61*e* of the carriage, the cylindrical surface portions 2*a* and 2*b* of the liquid jet recording head 51 are abutted against the receiving portions 61*b* and 61*c* of the carriage, and further the positioning bosses 6*b* of the liquid jet recording head 51 are abutted against predetermined receiving portions (not shown) of the carriage side, thereby the liquid jet recording head 51 is positioned with respect to the carriage with pinpoint accuracy.

Note that when the recording apparatus is arranged such that the frame member 16 receives all the press forces applied in the directions of the arrows A, B, C, and D by the presser means attached to the carriage, the liquid jet recording head 51 can store a large amount of the recording liquid (the volume of the common liquid chamber 17 is increased). Thus, it is not necessary to increase the size of the recording unit 15 or the flow path-forming member 6 even in a recording head in which the frame member 16 is increased in size, thereby the liquid jet recording head 51 can be manufactured at a low cost.

The cylindrical surface portions 2*a* and 2*b* of the second plate 5 (the first reference plane) that is the reference for mounting the recording element substrate 1 is also used as a mounting position determination reference for positioning the liquid jet recording head 51 with respect to the carriage. As a result, after the liquid jet recording head 51 has been mounted on the carriage, the amount of inclination of the recording element substrate 1 (discharge port row) is determined only by a value obtained by adding the adjustment accuracy of the recording element substrate 1 adjusted using the first reference plane of the first plate 2 as a reference to the abutment accuracy between the first reference plane and the receiving portions 61*b* and 61*c* of the carriage, thereby the liquid jet recording head 51 can mounted on the carriage with pinpoint positional accuracy.

Further, when the first plate 2 is formed of a rigid material such as ceramics, the dimensional accuracy and the geometrical accuracy of the first plate 2 are more improved, and thus the mounting accuracy of the recording element substrate 1 can be greatly improved.

Furthermore, when the first plate 2 is formed of the rigid material and the liquid jet recording head 51 is mounted on the carriage, the first reference plane of the first plate 2 is not deformed by a load applied thereto, thereby abutment position determination accuracy can be greatly enhanced.

Moreover, even if the liquid jet recording head 51 is often mounted on and dismounted from the carriage, the portion where the discharge ports are disposed can be reliably positioned with inclination accuracy having excellent reproducibility when the head is mounted on the carriage because the reference plane of the first plate 2 is excellent in wear resistance, thereby the reliability of the recording apparatus can be enhanced in its entirety.

In addition, when the first plate 2 is formed of alumina, the heat radiation characteristics of the alumina can be utilized in a liquid jet recording head which employs recording elements having high density and which is liable to be increased in temperature, thereby the temperature characteristics of the liquid jet recording head can be improved in its entirety. Further, since the alumina is excellent in chemical resistance and in rigidity and can be processed with high dimensional accuracy, it is suitable for various characteristics required by the first plate 2. Thus, the alumina can be preferably used for the first plate 2.

As described above, all the positioning reference portions, based on which the liquid jet recording head 51 is positioned, when it is mounted on the carriage, with respect to the directions A, B, and C, that is, with respect to all the three axial directions, are disposed to the recording unit 15, thereby the accumulated error of members and the accumulated error of dimensions from the recording element substrate 1 to the positioning reference portion disposed to the first plate 2 or the flow path-forming member 6 can be reduced. As a result, the positioning accuracy of the discharge ports can be greatly improved after the liquid jet recording head 51 has been mounted on the carriage.

Since the functions required to the liquid jet recording head 51 are concentrated to the recording unit 15 as described above, the reliability of the dimension reference portions can be greatly enhanced in the liquid jet recording head 51 by selecting materials and employing a mechanical structure from both of which high mechanical strength and pinpoint accuracy can be obtained.

In contrast, as to the frame member 16, less expensive materials can be selected for the first snap fits 18*a* and 18*b*, the second snap fits 19*a* and 19*b*, and the extending piece 31 as long as the materials have desired mechanical characteristics. Accordingly, the liquid jet recording head 51 having a high performance can be manufactured at a low cost by forming the recording unit 15 so that the necessary functions are concentrated therein in a minimum size and by forming all the other necessary sections of the frame member 16 using the less expensive materials.

Further, the inclination of the discharge ports in the direction where they are disposed, which is most important in the positioning of the liquid jet recording head 51, is set under the condition in which the mounting reference of the recording element substrate 1 is the same as the mounting condition of the liquid jet recording head 51 mounted on the carriage. Accordingly, the discharge ports are maintained with pinpoint accuracy at all times even in a recording apparatus in which the liquid jet recording head 51 is mounted on and dismounted from the carriage repeatedly.

Furthermore, the liquid jet recording head 51 can be manufactured with higher pinpoint accuracy by assembling all the members constituting the liquid jet recording head 51 using the position determining portions, based on which the liquid jet recording head 51 is mounted on the carriage, as references.

While a mode of the liquid jet recording head and the recording apparatus of the present invention has been described above, it is needless to say that the present invention can be applied to any arrangement of a recording apparatus in which only one set of the liquid jet recording head 51 is mounted on the carriage and a recording apparatus in which a plurality of the liquid jet recording heads 51 are mounted on the carriage.

The positioning reference portions for positioning the liquid jet recording head 51 with respect to all the three dimensional directions (three-axes directions) when it is mounted on the carriage may be disposed to the flow path-forming member 6. That is, when the positioning reference portions are concentrated to a single member, the productivity of the liquid jet recording head 51 can be improved by distinctly separating members having high accuracy and members having low accuracy.

Further, in this embodiment, the elastically deforming portions of the second snap fits 19*a* and 19*b* are extended in the direction orthogonal to the coupling direction of the frame member 16 and the flow path-forming member 6. However, the same effect can be obtained even if the elastically deforming portions of the second snap fits 19*a* and 19*b* are extended in a direction which inclines at 45° or more with respect to the coupling direction of the frame member 16 and the flow path-forming member 6.

In addition, in the liquid jet recording head of this embodiment, the recording unit 15 is coupled with the frame member 16 through the seal member 20 clamped therebetween. However, another arrangement in which the seal member 20 is not clamped therebetween, for example, an arrangement in which the respective recording liquid paths of the recording unit 15 and the frame member 16 are hermetically sealed with a seal material and the like may be employed.

(Second Embodiment)

Figure 14:
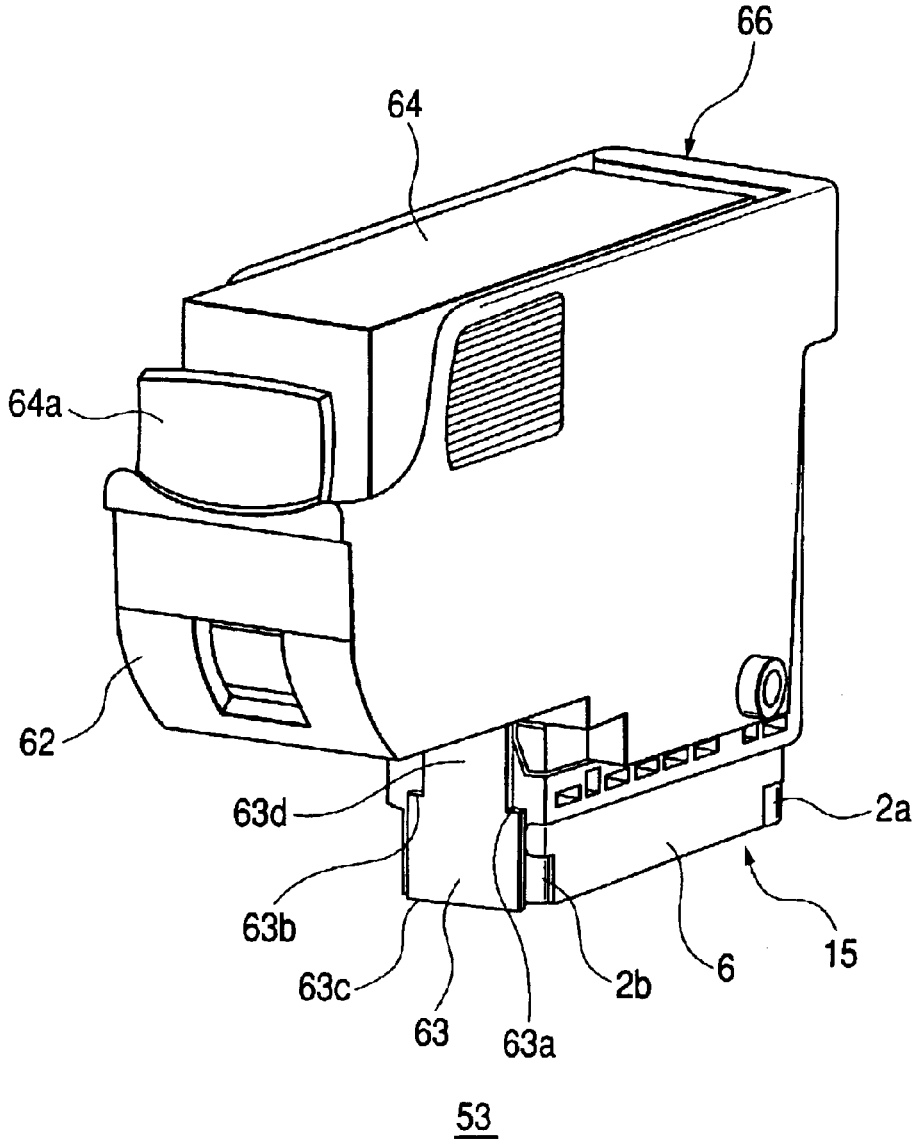
FIG. 14 is a perspective view showing an outside appearance of a liquid jet recording head according to a second embodiment having a cartridge type ink tank mounted thereon.
Figure 15:
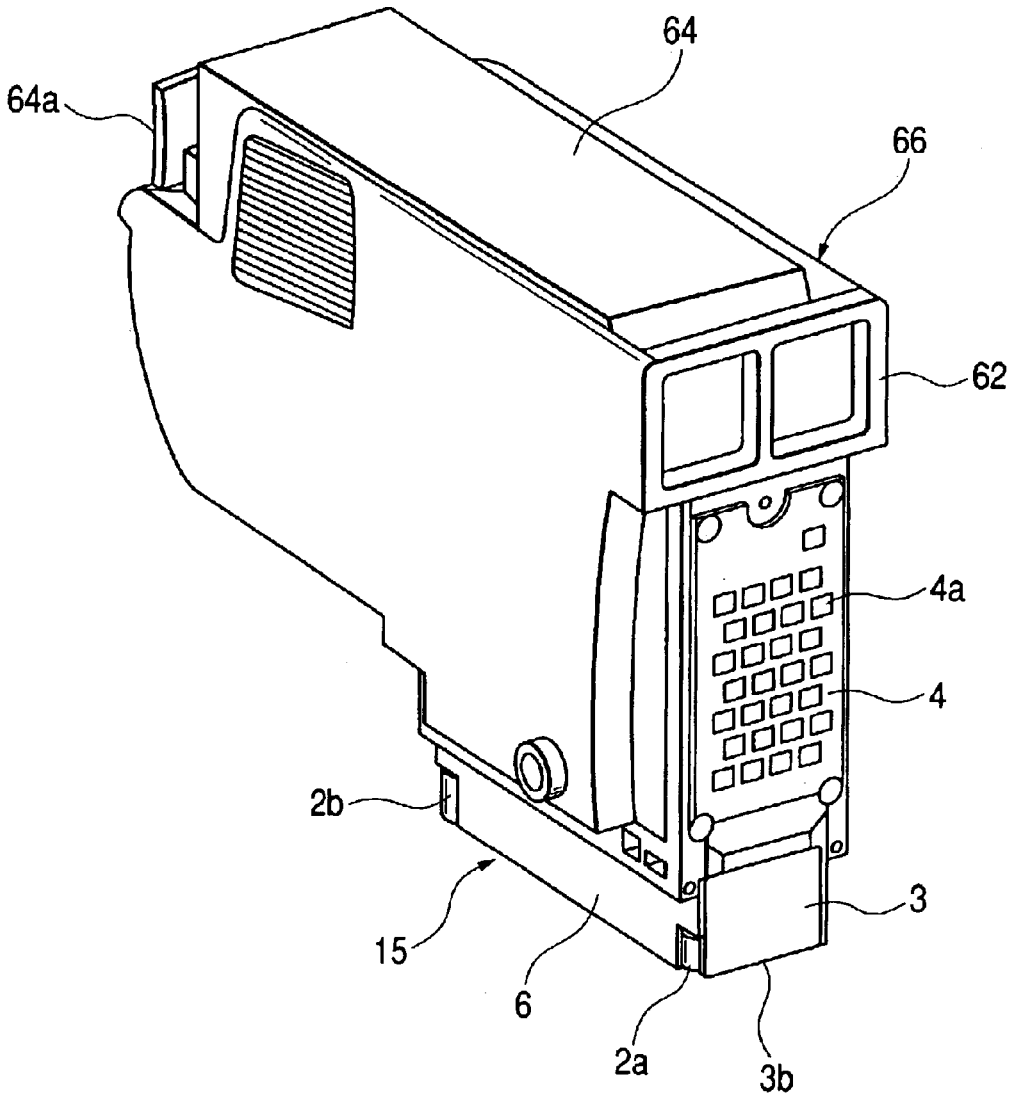
FIG. 15 is a perspective view showing the liquid jet recording head of the second embodiment when it is viewed from a terminal wiring substrate side.
Figure 16:
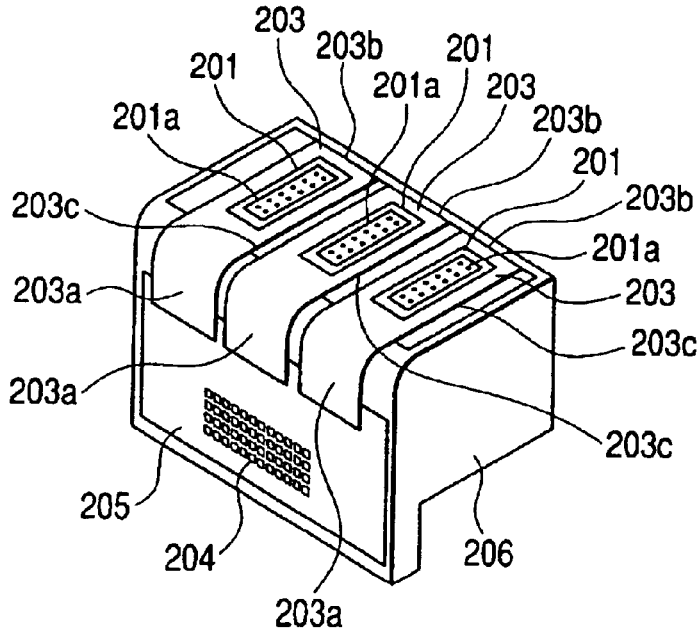
FIG. 16 PRIOR ART
FIG. 16 is a perspective view showing an outside appearance of a conventional liquid jet recording head.
Figure 17:
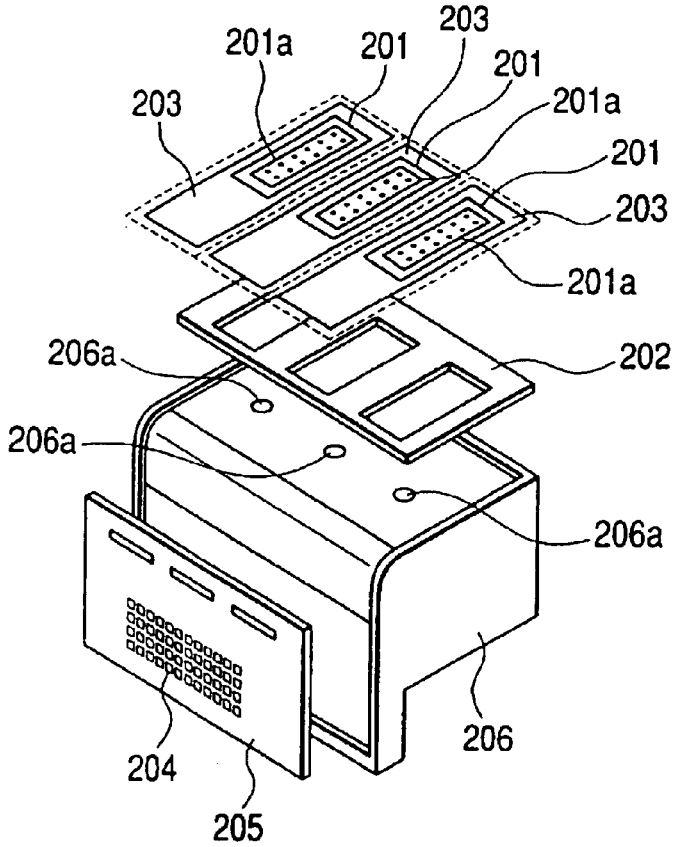
FIG. 17 PRIOR ART
FIG. 17 is an exploded perspective view showing the conventional liquid jet recording head.
Figure 18:
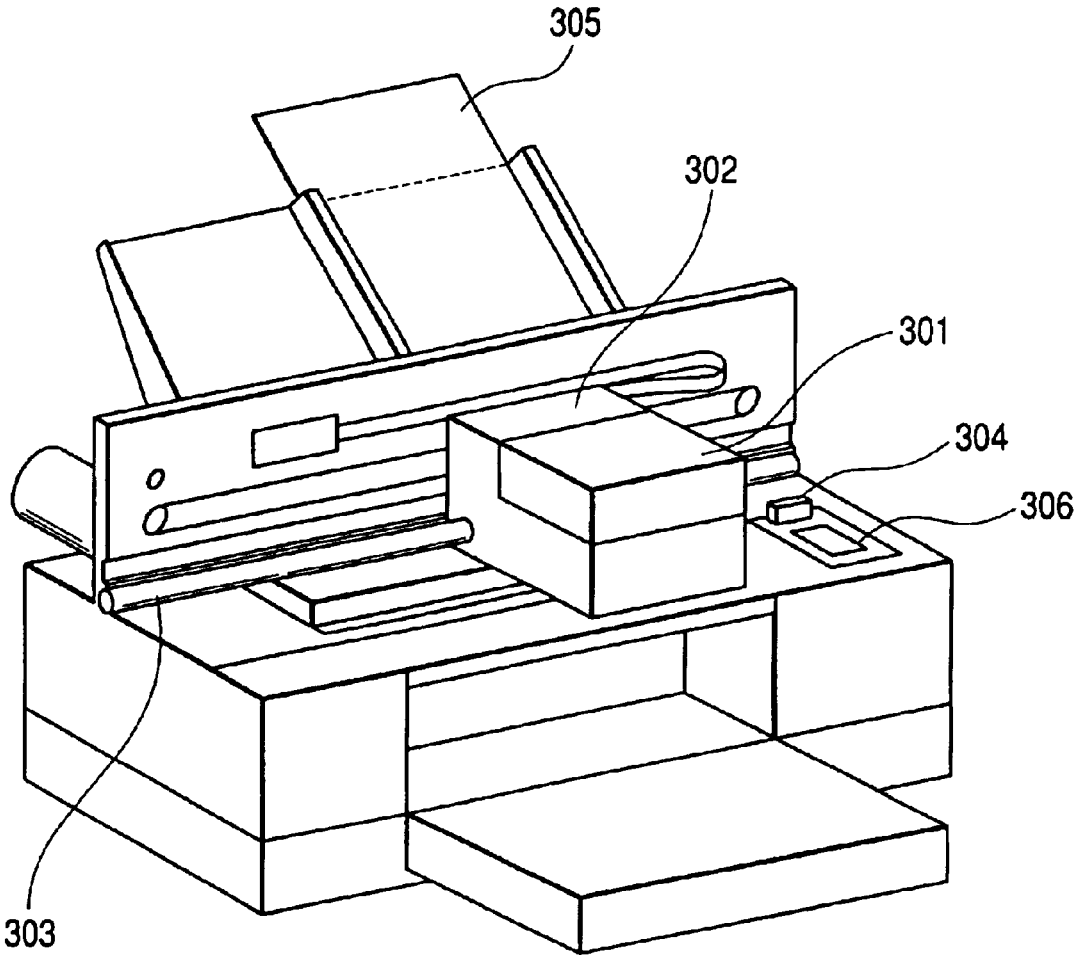
FIG. 18 PRIOR ART
FIG. 18 is a perspective view showing an outside appearance of a conventional recording apparatus.
Figure 19:
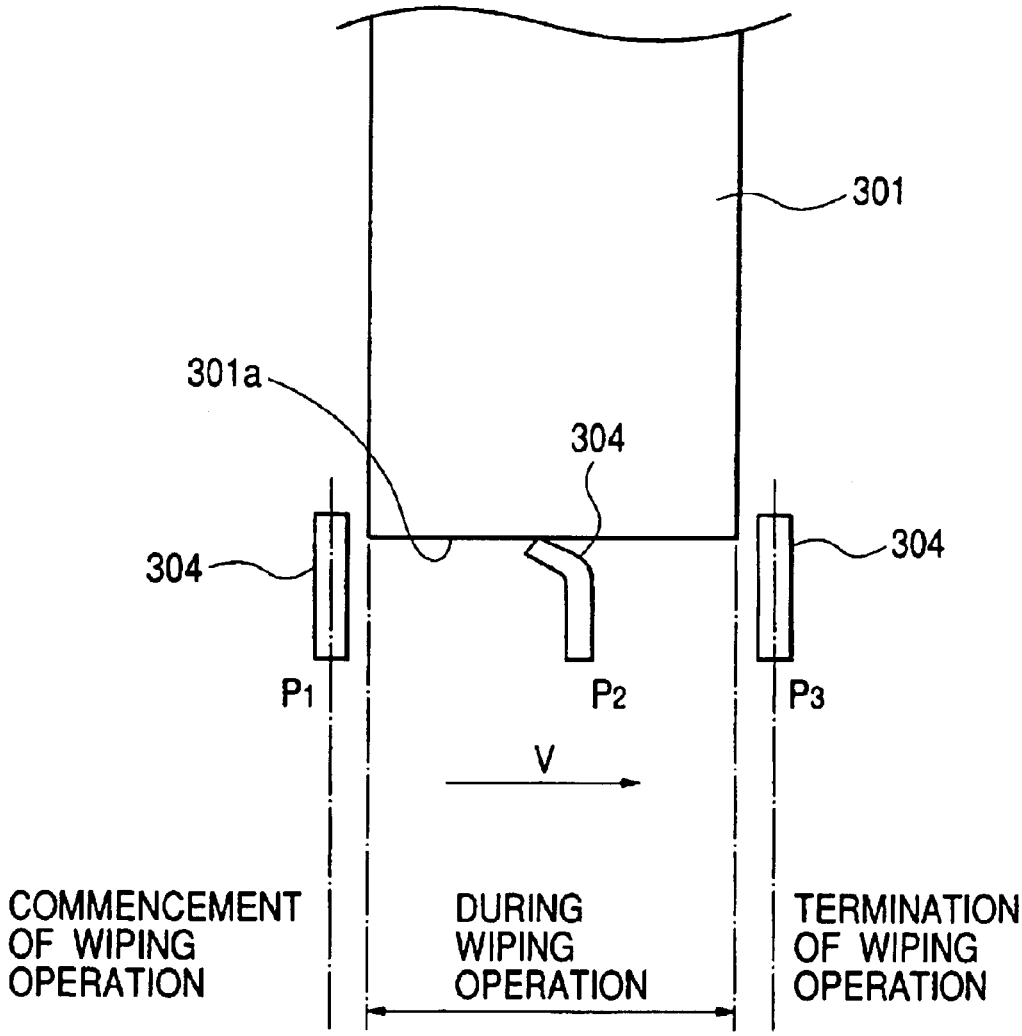
FIG. 19 PRIOR ART
FIG. 19 is a schematic view explaining a wiping operation executed by a blade in the conventional recording apparatus.

FIGS. 14 and 15 are perspective views showing outside appearances of a liquid jet recording head according to a second embodiment according to the present invention.

The liquid jet recording head of the embodiment is arranged such that a recording unit is coupled with a holder member that detachably holds and fixes a cartridge type ink tank. Note that, in the following description, the components of the liquid jet recording head of the second embodiment which are the same as those of the liquid jet recording head 51 of the first embodiment described above are denoted by the same reference numerals, and the description thereof is omitted. Also, the same components as those of the frame member 16 of the liquid jet recording head 51 described above are denoted by the same reference numerals and the description thereof is omitted for the sake of convenience.

The liquid jet recording head 53 includes the recording unit 15 and the holder member 62 detachably holding the cartridge type ink tank 64 as described above.

The holder member 62 has a loading section 66 opened on the upper portion thereof, and the cartridge type ink tank 64 is loaded in the holder member 62 through the loading section 66. The ink tank 64 has an engagement piece 64*a* formed on the outer periphery thereof, and the engagement piece 64*a* is engaged with an engagement portion (not shown) disposed to the loading section 66 to thereby prevent the ink tank 64 from dropping from the loading section 66.

The holder member 62 has an extending piece 63 formed integrally therewith, and the extending piece 63 is engaged with an engagement projection 9*b* of a flow path-forming member 6 on the recording unit 15 side. The extending piece 63 extends toward the recording unit 15 to a position corresponding to a lateral side surface of a first plate 2 located on the recording unit 15 side. The extending piece 63 has a distal end portion 63*c* extending to a position where it covers a side end 3*c* of a wiring sheet 3 of the recording unit 15. The distal end portion 63*c* slightly projects beyond a face surface 3*a* of the wiring sheet 3 in a recording liquid discharging direction, which is a direction approximately orthogonal to the face surface 3*a* in a state in which the holder member 62 is coupled with the flow path-forming member 6. In other words, the distal end portion 63*c* of the extending piece 63 is located adjacent to the side end 3*c* of the wiring sheet 3 such that an inner wall of the extending piece 63 faces the outer periphery of the face surface 3*a* in a state in which the holder member 62 is coupled with the flow path-forming member 6, thereby the side end 3*c* acts as a protection wall.

The extending piece 63 is formed in an approximately T-shaped flat shape and has an elastically deforming portion 63*d* at a base end which can be elastically deformed in a thickness direction. Further, the extending piece 63 has hooks 63*a* and 63*b* formed by cutting out it on both the sides thereof in a width direction parallel with the lateral direction of the first plate 2, the hooks 63*a* and 63*b* being engaged with third receiving portions 6*m* and 6*n* of the flow path-forming member 6.

While not shown, the holder member 62 has first and second snap fits disposed thereto similarly to the frame member 16 described above. When the first and second snap fits and the extending piece 63 are engaged with first receiving portions 6*e* and 6*f*, second receiving portions 6*g* and 6*h*, and the third receiving portion 6*m* and 6*n* of the recording unit 15, respectively, the holder member 62 is coupled with and fixed to the recording unit 15.

Finally, a recording apparatus of the embodiment including the liquid jet recording head 51 described above will be described. While not shown, the recording apparatus includes a recording unit, a transfer unit, a discharge unit, and the recovery unit described above. The recording unit has the liquid jet recording head 51 described above for recording information such as an image and the like on a recording sheet, the transfer unit transfers the recording sheet to the recording unit, and the discharge unit discharges the recording sheet on which the information has been recorded to the outside of the recording apparatus.

The transfer unit has a transfer roller for transferring the recording sheet and a transfer mechanism for driving the transfer roller in rotation. Likewise, the discharge unit has a discharge roller for discharging the recording sheet and a discharge mechanism for driving the discharge roller in rotation.

In the recording apparatus arranged as described above, the recording sheet is transferred to the recording unit by the transfer roller of the transfer unit, and the recording liquid is discharged by the liquid jet recording head 51, thereby information such as a desired image and the like is recorded on the recording sheet. The discharge unit transfers the recording sheet, on which the information has been recorded, by means of the discharge roller and discharge it to the outside of the recording apparatus.

Note that since a wiping operation executed to the liquid jet recording head 51 by the blade of the recovery unit has been described above in relation to the liquid jet recording head 51 of the first embodiment described above, the description of the wiping operation is omitted. It is needless to say that the recording apparatus may include the liquid jet recording head 53 described above.

As described above, according to the liquid jet recording heads 51 and 53 and the recording apparatuses of the embodiments, the extending piece 31 whose distal end portion 31*c* projects beyond the face surface 3*a* of the wiring sheet 3 is disposed to the frame member 16 or to the holder member 62 each coupled with the recording unit 15. Thus, it is possible for the distal end of the blade 41 to reach the face surface 3*a* without being caught by a ridgeline of the side end 3*c* of the wiring sheet 3. Further, since the distal end of the blade 41 is curved just after the blade 41 comes onto the face surface 3*a*, the blade 41 can exert an excellent wiping performance even just after it comes onto the face surface 3*a*.

That is, according to the liquid jet recording heads 51 and 52 and the recording apparatuses, the wiring sheet 3 can be securely prevented from being exfoliated from the side end 3*c* by the blade 41 executing the wiping operation as well as the wiping operation can be suitably executed on the face surface 3*a*, and the durability of the blade 41 can be improved.

Additionally, the extending piece 31 has a very simple structure because it is formed by being extended from the frame member 16 or the holder member 62 toward the recording unit 15. Thus, the extending piece 31 can be easily disposed at a low cost. Further, in the liquid jet recording heads 51 and 53, no portion projecting in the direction, in which the recording liquid is discharged from the face surface 3*a*, is formed at positions corresponding to the ridge lines of the other three sides of the face surface 3*a* except the ridge line of the side end 3*c* of the wiring sheet 3 located adjacent to the distal end portion 31*c* of the extending piece 31. With this arrangement, even if a part of the recording liquid remains in the wiping operation without being wiped by the blade 41, the remaining recording liquid can be reliably removed by the wiping operation executed in the subsequent processes because no corner, where the remaining recording liquid stays, exists in a direction where the blade 41 advances.

Also in the recording apparatus, the distal end portion 31*c* of the extending piece 31 projects beyond the face surface 3*a*. Thus, when, for example, a recording sheet having a relatively easily curling habit passes through the recording apparatus or when clogged recording sheet removal processing is executed, even if the recording sheet approaches the discharge ports, the distal end portion 31*c* of the extending piece 31 can prevent the recording sheet from coming into contact with the discharge ports. Accordingly, in the recording apparatuses, the periphery of the discharge ports is prevented from being damaged and the recording liquid in the periphery of the discharge ports is prevented from being dragged by the recording sheet, thereby excellent recording quality can be maintained.

Further, according to the recording apparatuses, when the liquid jet recording head having the same specification is mounted on the respective modes of a serial type recording apparatus and a line type recording apparatus, the recording head can be easily mounted on the recording apparatuses of the respective modes by selectively coupling the frame member 16 or the holder member 62 each having the extending piece 31 and the frame member 16 or the holder member 62 each not having the extending piece 31 with the recording unit 15. That is, according to the recording apparatuses, since the recording unit, which acts as a main component for the recording liquid discharging operation, is used commonly as well as the frame member 16 and the holder member 62, which can be manufactured at a relatively low cost, are used for a dedicated purpose, the manufacturing cost for manufacturing the two types of the liquid jet recording heads and recording apparatuses each having a different specification can be reduced, thereby productivity can be greatly improved.

Furthermore, in the liquid jet recording heads 51 and 53, the hooks 31*a* and 31*b* are disposed to the extending piece 31 and engaged with the third receiving portions 6*m* and 6*n* of the flow path-forming member 6. Thus, even if an external force is applied in a direction where the extending piece 31 is separated from the wiring sheet 3, the extending piece 31 is prevented from being bent in a direction where the extending piece 31 is disengaged by the frictional resistance resulting from the engaged state of the hooks 31*a* and 31*b* with the third receiving portions 6*m* and 6*n*.

Accordingly, in the liquid jet recording head 51, disposing the extending piece 31 to the frame member 16 increases the length of the elastically deforming portion 31*d* of the extending piece 31 in a longitudinal direction and reduces the bending rigidity of the elastically deforming portion 31*d*. However, the frame member 16 is not easily disengaged from the flow path-forming member 6 even if the thickness of the elastically deforming portion 31*d* is reduced, thereby the size of the liquid jet recording head 51 can be reduced in its entirety.

Further, in the liquid jet recording head 51, the recording unit 15 is coupled with the frame member 16 by the respective engaged states of the first and second snap fits and the extending piece. Accordingly, even if the liquid jet recording head 51 is dropped by mistake and subjected to impact loads acting in various direction, the hooks are not removed from the engaged portions. Therefore, the liquid jet recording head can obtain high reliability.

Since the functions required to the liquid jet recording head 51 are concentrated to the recording unit 15, the reliability of the dimension reference portions of the liquid jet recording head 51 can be greatly enhanced by selecting the materials and employing the mechanical structure from both of which high mechanical strength and pinpoint accuracy can be obtained. In contrast, as to the frame member 16 and the holder member 62, the less expensive materials can be selected for the first snap fits 18*a* and 18*b*, the second snap fits 19*a* and 19*b*, and the extending piece 31 as long as they have the desired mechanical strength. Thus, the liquid jet recording heads 51 and 53 having a high performance can be manufactured at a low cost by forming the recording unit 15 by concentrating the functions necessary thereto in the minimum size.

Further, in the liquid jet recording heads 51 and 53, the pairs of hooks, which are in confrontation with the first snap fits 18*a* and 18*b* and the second snap fits 19*a* and 19*b*, are formed in confrontation with the direction where they are engaged with the first receiving portions 6*e* and 6*f* and the second receiving portions 6*g* and 6*h*, thereby the engaged state of the hooks can be firmly maintained.

Furthermore, in the liquid jet recording heads 51 and 53, since the extending piece 31 is disposed in the vicinity of the second snap fits 19*a* and 19*b*, engagement strength obtained by the extending piece 31 can supplement the engagement strength in a direction where the recording unit 15 is separated from the frame member 16 or the holder member 62 in the second snap fits 19*a* and 19*b*.

As described above, according to the present invention, the projecting section extends from the recording liquid storage unit or the holder member toward the outer peripheral edge of the surface of the recording unit on the recording liquid discharge side thereof such that the distal end of the projecting section covers the side end of the one end portion of the wiring sheet facing the outer periphery of the surface of the recording unit on the recording liquid discharge side thereof, thereby the wiring sheet can be prevented from being exfoliated from the side end of the one end portion thereof. Further, the projecting section can be easily manufactured at the low cost because it has a very simple structure such that it is extended from the recording liquid storage unit or from the holder member toward the outer peripheral edge of the surface of the recording unit on the recording liquid discharge side.

Further, according to the recording apparatuses of the present invention, they are provided with the recovery unit which has the sliding contact member for wiping the recording liquid in contact with the surface of the liquid jet recording head on the liquid discharge side thereof. Therefore, a cleaning operation of the surface on the liquid discharge side can be securely executed, thereby the durability of the sliding contact member can be improved.

What is claimed is:

1. A liquid jet recording head comprising:

a recording portion having a recording element substrate provided with a recording element for discharging liquid and a face surface provided with a discharge port for discharging liquid, a wiring sheet electrically connected to said recording element substrate being provided at a periphery of said face surface;

a recording liquid storing portion for storing the recording liquid supplied to said recording portion;

a coupling member for coupling said recording portion and said recording liquid storing portion to constitute said liquid jet recording head; and a projecting member provided on said recording liquid storing portion, wherein said coupling member couples said recording portion and said recording liquid storing portion so that a leading end of said projecting member projects beyond a position of an end of said face surface from a side of said recording portion when said recording portion is coupled with said recording liquid storing portion.

2. A liquid jet recording head according to claim 1, wherein said coupling member couples said recording portion and said recording liquid storing portion so that said coupling member engages with said recording liquid storing portion from a side opposed to said face surface of said recording portion, and upon coupling, said leading end of said projecting member projects, in a discharge direction of the recording liquid, from said face surface from the side of said recording portion.

3. A liquid jet recording apparatus comprising:

a liquid jet recording head according to claim 2; and a rubbing member for wiping the recording liquid deposited on said face surface by rubbing said face surface of said liquid jet recording head.

4. A liquid jet recording apparatus according to claim 3, wherein said rubbing member wipes the recording liquid by contacting said discharge port after contacting said projecting member when rubbing said face surface.

5. A liquid jet recording head according to claim 1, wherein said leading end of said projecting member projects beyond a position of said wiring sheet that is provided at said periphery of said face surface provided with the discharge port and that applies an electrical signal to said recording element substrate.

6. A liquid jet recording apparatus comprising:

a liquid jet recording head according to claim 5; and a rubbing member for wiping the recording liquid deposited on said face surface by rubbing said face surface of said liquid jet recording head.

7. A liquid jet recording apparatus according to claim 6, wherein said rubbing member wipes the recording liquid by contacting said discharge port after contacting said projecting member when rubbing said face surface.

8. A liquid jet recording head according to claim 1, wherein said recording portion is provided to cover a periphery of said recording element substrate and has said wiring sheet having flexibility for transmitting a recording signal to said recording element substrate.

9. A liquid jet recording apparatus comprising:

a liquid jet recording head according to claim 8; and a rubbing member for wiping the recording liquid deposited on said face surface by rubbing said face surface of said liquid jet recording head.

10. A liquid jet recording apparatus according to claim 9, wherein said rubbing member wipes the recording liquid by contacting said discharge port after contacting said projecting member when rubbing said face surface.

11. A liquid jet recording apparatus comprising:

a liquid jet recording head according to claim 1; and a rubbing member for wiping the recording liquid deposited on said face surface by rubbing said face surface of said liquid jet recording head.

12. A liquid jet recording apparatus according to claim 11, wherein said rubbing member wipes the recording liquid by contacting said discharge port after contacting said projecting member when rubbing said face surface.

* * * * *

UNITED STATES PATENT AND TRADEMARK OFFICE

CERTIFICATE OF CORRECTION

PATENT NO. : 6,913,351 B2
DATED : July 5, 2005
INVENTOR(S) : Yukuo Yamaguchi et al.

It is certified that error appears in the above-identified patent and that said Letters Patent is hereby corrected as shown below:

Column 4,
Line 12, “is arisen” should read -- arises --.
Line 23, “is” should be deleted.
Line 24, “arisen” should read -- arises --.
Line 35, “is also arisen” should read -- also arises --.
Line 37, “having” should be deleted.

Column 9,
Line 41, “section” should read -- sections --.

Column 10,
Line 31, “out it,” should read -- it out, --.

Column 14,
Line 40, “direction-thereof” should read -- direction thereof --.
Line 42, “fist” should read -- first --.

Column 15,
Line 6, “engaged” should read -- engaged with --.

Column 17,
Line 5, “an increase” should read -- by an increase --.

Column 21,
Line 32, “to” should read -- of --.
Line 33, “to” should read -- in --.

UNITED STATES PATENT AND TRADEMARK OFFICE

CERTIFICATE OF CORRECTION

PATENT NO. : 6,913,351 B2
DATED : July 5, 2005
INVENTOR(S) : Yukuo Yamaguchi et al.

It is certified that error appears in the above-identified patent and that said Letters Patent is hereby corrected as shown below:

Column 23,
Line 18, "out it" should read -- it out --, and "the" should be deleted.
Line 55, "discharge" should read -- discharges --.

Signed and Sealed this

Thirtieth Day of May, 2006

JON W. DUDAS
*Director of the United States Patent and Trademark Office*